US009930935B2

(12) United States Patent
King

(10) Patent No.: US 9,930,935 B2
(45) Date of Patent: Apr. 3, 2018

(54) ADJUSTABLE REVERSIBLE BELT WITH POPULAR BUCKLE

(71) Applicant: Allen King, San Jose, CA (US)

(72) Inventor: Allen King, San Jose, CA (US)

( * ) Notice: Subject to any disclaimer, the term of this patent is extended or adjusted under 35 U.S.C. 154(b) by 1053 days.

(21) Appl. No.: 13/797,240

(22) Filed: Mar. 12, 2013

(65) Prior Publication Data

US 2014/0259545 A1 Sep. 18, 2014

(51) Int. Cl.
*A41F 19/00* (2006.01)
*A44B 11/00* (2006.01)
*A41F 9/00* (2006.01)

(52) U.S. Cl.
CPC ..... *A44B 11/006* (2013.01); *A41F 9/002* (2013.01); *Y10T 24/4016* (2015.01); *Y10T 29/12* (2015.01)

(58) Field of Classification Search
USPC ..... 24/182; 2/300, 301, 319, 320, 321, 322, 2/338, 312
See application file for complete search history.

(56) References Cited

U.S. PATENT DOCUMENTS 1,285,981 A * 11/1918 Glassburn ..... A41F 11/02 236/68 B
1,662,074 A * 3/1928 McMeans ..... A44B 11/28 2/321
2,247,835 A * 7/1941 Gassert ..... A41F 9/002 2/322
2,634,480 A * 4/1953 Ray ..... A44B 11/223 24/180
2,644,994 A * 7/1953 Smith ..... A41F 9/002 24/182
2,686,920 A 8/1954 Meeker
3,440,667 A 4/1969 Dye
3,855,637 A 12/1974 Luger
3,866,276 A * 2/1975 Perkins ..... A41F 9/002 2/311
3,913,147 A * 10/1975 Ostrander ..... A44B 11/22 2/311

(Continued)

FOREIGN PATENT DOCUMENTS

FR 838311 * 3/1939

OTHER PUBLICATIONS

"CLP114BLKJ, Locking Steel Belt Clip", Granat Industries, Inc. know about as early as Jun. 1, 2013.

*Primary Examiner* — Khaled Annis
*Assistant Examiner* — Brieanna Szafran

(57) ABSTRACT

A single-sided or reversible belt includes a single-sided or double-sided belt strap without any adjusting hole, any popular belt buckle of a frame style or plate style with its prong or projection removed, and new belt fastening means. The belt buckle is providable with a retainer loop on the rear side adjacent an outer end to keep the outer end portion of the belt buckle from dangling after belt buckling. A first fastening element is installed on underside or double sides of a belt strap free end portion, for example. An adjustably slidable locking belt clip is then used to engage a belt strap fixed end portion and carries a mating second fastening element. For belt fastening, the belt clip is manually slid along the engaged belt strap end portion to keep the two fastening elements aligned, leading to having them fastened together. This kind of belt may be used on such articles as trousers and shoes.

12 Claims, 21 Drawing Sheets

(56) References Cited

U.S. PATENT DOCUMENTS

| | | | | |
|---|---|---|---|---|
| 4,173,794 | A | 11/1979 | Nichols | |
| 4,280,254 | A | 7/1981 | Racke | |
| 5,036,864 | A * | 8/1991 | Yewer, Jr. | A41F 9/002 128/876 |
| 5,044,049 | A | 9/1991 | Owens et al. | |
| 5,214,806 | A * | 6/1993 | Flores | A41B 13/00 2/300 |
| 5,331,721 | A | 7/1994 | Raum, Sr. | |
| 5,920,964 | A * | 7/1999 | Malzahn | A41F 9/002 24/163 K |
| 6,145,169 | A | 11/2000 | Terzuola et al. | |
| 6,830,166 | B1 * | 12/2004 | Laats | A44C 5/0053 224/164 |
| 7,765,620 | B2 * | 8/2010 | Belouin | A41F 9/007 2/319 |
| 7,926,151 | B1 | 4/2011 | MacWilliam | |
| 7,950,072 | B1 | 5/2011 | Hanson | |
| 8,468,658 | B1 * | 6/2013 | Rife | A41F 9/002 24/182 |
| 2007/0033698 | A1 * | 2/2007 | Long | A41F 9/007 2/94 |
| 2012/0060263 | A1 * | 3/2012 | Harber | A41F 9/002 2/338 |

* cited by examiner

ADJUSTABLE REVERSIBLE BELT WITH POPULAR BUCKLE

FIELD

The subject matter disclosed herein relates to belts and more particularly relates to adjustable reversible belts with popular buckles without having size adjustment holes in the belts.

BACKGROUND

Description of the Related Art

A typical contemporary single-sided or double-sided belt for garment worn around a waist has holes punched in the belt longitudinally spaced one inch apart and uses a belt buckle with either a prong or a rear projection that fits into one such selected hole to fasten the two ends of the belt together. During the course of a day or after a meal the wearer may find the belt slightly too loose or slightly too tight. Unfortunately, such belt only allows one inch adjustment, resulting in either one size too small or one size too large for its wearer.

BRIEF SUMMARY

An adjustable belt according to the present invention includes at least one single-sided or double-sided belt strap without any adjusting hole configured to have a free end portion and a fixed end portion, a belt buckle of frame style or plate style without a prong or projection conventionally used for belt fastening configured to have an outer end and an inner end, and belt fastening means for fastening said belt strap free end portion and said belt strap fixed end portion together. The belt buckle is providable with a retainer loop on the rear side near the outer end to first receive said belt strap free end portion, thereby holding the outer end portion of the belt buckle from dangling. Belt fastening means includes a first fastening element fixedly installed on, for example, said belt strap free end portion underside or double sides depending on whether said at least one belt strap is single-sided or double-sided, an adjustably slidable belt clip of locking type engaging said belt strap fixed end, and a mating second fastening element installed on the first leaf of the belt clip and alignable with the first fastening element for belt fastening by sliding the belt clip along the engaged belt strap fixed end portion manually with force.

In another aspect of the present invention, a system is presented to attach said adjustable belt to an article of garment such as trousers or non-garment such as shoe, wherein each of two separate built-in straps is affixed to the body of the shoe at one end, and at the other ends said straps also have a free end portion and a fixed end portion, respectively. The two ends are fastened together by means of the stationary first fastening element and the slidable second fastening element using a belt clip as a carrier. Said article also has belt attachment support structure. For example, for a waist belt, trousers provide a waist band and sewn-on belt loops therearound. The waist belt may be attached to the trousers through the belt loops.

A method of the present invention is also presented for assembling and disassembling said adjustable belt. The method in the disclosed embodiments substantially includes the steps necessary to carry out the functions presented above with respect to the operation of the described adjustable belt and system. The method includes providing at least one belt strap without any adjusting hole configured to have a free end portion and a fixed end portion, providing a belt buckle of frame style or plate style having no prong or projection used for belt fastening and having an outer end and an inner end, with the rear side configurable to have a retainer loop near the outer end for receiving said belt strap free end portion thereby keeping the belt buckle from dangling, providing a first fastening element and a mating second fastening element, providing an adjustably slidable belt clip of a locking type having a first leaf and a second leaf engageable therebetween to either said belt strap end portion, installing the first fastening element single-sided or double-sided on one said belt strap end portion depending on whether said at least one belt strap is single-sided or double-sided, installing the second fastening element on the first leaf of the belt clip, securing said belt strap fixed end portion to the belt buckle, engaging the belt clip to the other said belt strap end portion, beginning threading said belt strap free end portion through the belt buckle from underside and the retainer loop, if existing, toward an inner end of the belt buckle, extending the travel of said belt strap free end portion for a desired distance beyond the belt buckle, adjustably sliding the belt clip along the engaged belt strap end portion to align the two fastening elements by a manual force, fastening the two fastening elements together, separating the two fastening elements from each other, and retracting said belt strap free end portion out of the belt buckle.

The adjustable belt disclosed is applicable to a single-side belt as well as a reversible belt. Even though the conventional prong and adjusting holes are eliminated, the belt buckle is kept from dangling after the free end portion is threaded through the belt buckle because of the use of a rear retainer loop at the outer end. The new belt fastening means provides unlimited belt size adjustability resulting from a manually adjustably slidable locking belt clip in use. The familiar aesthetic appearance and non-functional significance of popular conventional belt buckles are retained, despite the removal of prongs or projections.

BRIEF DESCRIPTION OF THE DRAWINGS

In order that the advantages of the embodiments of the invention will be readily understood, a more particular description of the embodiments briefly described above will be rendered by reference to specific embodiments that are illustrated in the appended drawings. Understanding that these drawings depict only some embodiments and are not therefore to be considered to be limiting of scope, the embodiments will be described and explained with additional specificity and detail through the use of the accompanying drawings, in which.

DETAILED DESCRIPTION

Figure 1A:
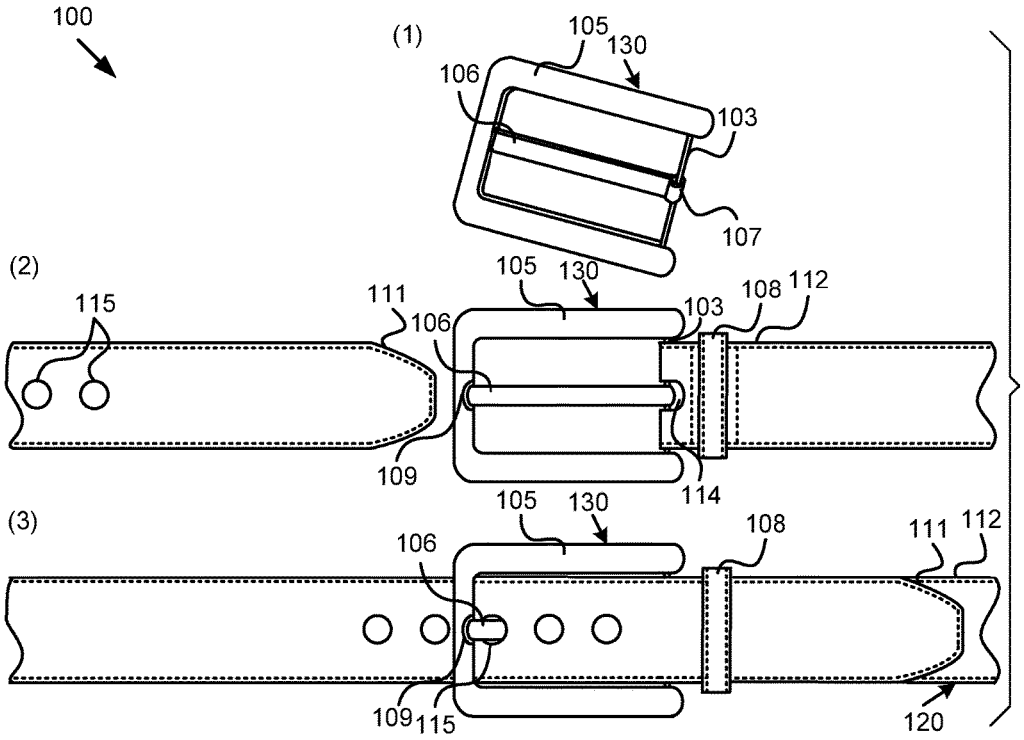
FIG. 1a (Prior Art)
FIG. 1*a* is a front elevational view of a conventional belt including at least one single-sided belt strap with a frame-style belt buckle having a prong affixed thereto, in both open and closed positions.

References throughout this specification to features, advantages, or similar language do not imply that all of the features and advantages may be realized in any single embodiment. Rather, language referring to the features and advantages is understood to mean that a specific feature, advantage, or characteristic is included in at least one embodiment. Thus, discussion of the features and advantages, and similar language throughout this specification may, but do not necessarily, refer to the same embodiment.

Furthermore, the described features, advantages, and characteristics of the embodiments may be combined in any suitable manner. One skilled in the relevant art will recognize that the embodiments may be practiced without one or more of the specific features or advantages of a particular embodiment. In other instances, additional features and advantages may be recognized in certain embodiments that may not be present in all embodiments.

These features and advantages of the embodiments will become more fully apparent from the following description and appended claims, or may be learned by the practice of embodiments as set forth hereinafter. As will be appreciated by one skilled in the art, aspects of the present invention may be embodied as a system, apparatus, and/or method.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, structures, or characteristics of the embodiments may be combined in any suitable manner. In the following description, numerous specific details are provided for a thorough understanding of embodiments. One skilled in the relevant art will recognize, however, that embodiments may be practiced without one or more of the specific details, or with other methods, components, materials, and so forth. In other instances, well-known structures, materials, or operations are not shown or described in detail to avoid obscuring aspects of an embodiment.

FIGS. 1*a*-1*f* illustrate widely-used contemporary conventional belts with vast majority of extremely popular belt buckles for use in garments such as trousers, skirts, and coats requiring a waist belt and in non-garment articles such as shoes, watchbands, handbags, strapping and the like requiring strap fastening. Although for those non-garment articles, "straps" are more commonly referred to than "belts", since those straps with buckles have a belt-like structure, hereinafter they are called belts rather than straps unless otherwise noted. Each of those waist belts usually has five or seven longitudinally spaced through holes punched in a belt strap near the belt tip, and the inter-hole spacing is one inch. A higher priced belt may have three holes instead. These holes allow the belt to be adjusted in circumference by one-inch increment. These holes have been referred to by various names such as punch holes, adjusting holes, size adjustment holes, sizing holes, prong holes, belt holes and so forth. Hereinafter only "adjusting holes" are referred to.

The center hole is usually used to fit one's waist size (for example, 34 inches). Selecting another hole that is closer to or farther away from the tip end, for example, is equivalent to wearing a one-size larger belt (35 inches) or a one-size smaller belt (33 inches), respectively. Such adjustment made after a heavy meal, for example, may make the wearer feel that the trousers are too loose, or in the morning (as opposed to later during the day), they are too tight, since the wearer's weight change then is generally slight, not requiring one-inch adjustment. As a case in point, using a one-size larger belt after a sizable meal is definitely inappropriate as some medical experts note that one-inch gain in waist size is roughly equivalent to a 10-pound total weight gain.

As well known in the art, each shown belt (strap) has a free end (belt tip end) and a fixed end (where the belt strap is generally attached to the belt buckle), and its featured belt buckle has either a prong located on its front side or a projection commonly called peg, stud, or hook, situated on its underside (or the rear side). Properly speaking, the belt buckle is a device for joining the free end portion of the belt and the fixed end portion of the belt together by the wearer, also referred to as user, by inserting the prong or the projection into a selected said hole. Thus, belt's two ends are fastened together through the belt buckle, for example, to hold up trousers when worn around the waist, or tighten up a shoe when worn around foot (or ankle). Although not explicitly shown herein, a type of belt buckles known as "box-out buckles" usually made with strong leather or other synthetic material is increasingly popular after Hollywood began using them in movies for their "fresh and new look". They make more of a fashion statement than provide functionality. Structurally, they are like plate-style belt buckles, often with a pivotable or hinged retainer loop often made of metal on the inner rear side as seen on plate-style belt buckles.

Because the popular conventional belt buckle types presented are referred to repeatedly in subsequent sections, a brief description of each type herein is in order. However, with similar elements and functions thereof that exist in the various types of belt buckles presented, description repetitions are avoided. In general, the description of each drawing may refer to elements of other previously provided drawings, like numbers referring to like elements.

FIG. 1*a* is a front elevational view of a conventional belt 100 including at least one single-sided belt strap 120 with a frame-style belt buckle 130 having a prong 106 affixed thereto, in both open and closed positions, as illustrated at (2) and (3), respectively. A rear view of the belt buckle 130 is illustrated at (1). Although the belt buckle body 105 shown is rectangular and of normal size, a variety of other shapes, configurations and sizes are available. The front tip of the prong 106 normally rests on a semi-circular notch 109 on the front part of the belt buckle body 105. The belt buckle 130 has an end bar 103 around which the tail end 107 of the prong 106 is wrapped and bent into a closed loop, making the prong 106 irremovable as illustrated at (1). The belt buckle 130 and the prong 106 are often made from metal although belt buckles made from plastic and other types of material are also available.

The belt 100 as illustrated at (2) and (3) uses either one single-sided belt strap such as usually seen on a waist belt or two singled-sided belt straps such as often seen on footwear or watchband, which has one end of each belt strap affixed to the body of the using article. In either case, the at least one belt strap 120, which may be made of leather, vinyl or other suitable material, has a free end 111 portion at the belt strap tip and a fixed end 112 portion. The fixed end 112 portion is affixed to the belt buckle 130 by folding its belt strap terminal portion back around the end bar 103 with a U-shaped cutout 114, which is used to accommodate the prong 106. Two transverse rows of stitches through the front and back of the fixed end 112 are provided to secure the fixed end 112 to itself, with a keeper 108 located between the two rows of stitches. The combination of the foldback belt strap fixed end 112 portion, the keeper 108 and the two rows of stitches is referred to as keeper assembly.

The keeper 108 typically is a loop made of the same material as the belt strap or metal like that is used by a metallic belt buckle and used to hold the free end 111 portion of the belt strap feeding through the belt buckle 130 flat. The at least one belt strap 120 as shown has edge stitches all around. Longitudinally spaced adjusting holes 115, one inch apart, are punched through the belt strap free end 111 portion as illustrated at (2) and (3). For belt fastening, the free end 111 portion is inserted through the belt buckle 130 from underneath at its outer end and outwardly toward the front of the belt buckle 130, allowing the prong 106 to be inserted into a selected adjusting hole 105 and is further threaded toward an inner end of the belt buckle 130 and through the keeper 108, the end result of which operation is illustrated at (3), wherein a closed position of the belt 100 is shown.

Figure 1B:
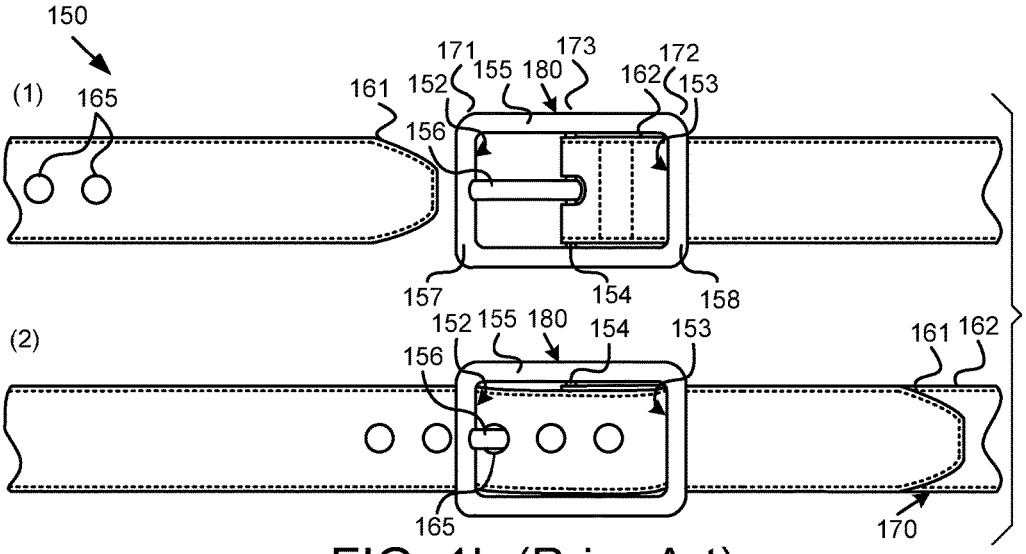
FIG. 1b (Prior Art)
FIG. 1*b* is a front elevational view of a conventional belt including at least one belt strap with a frame-style belt buckle having a center bar and a prong affixed thereto, in both open and closed positions.

FIG. 1*b* is a front elevational view of a conventional belt 150 including at least one belt strap 170 with a frame-style belt buckle 180 having a center bar 154 and a prong 156 affixed thereto, in both open and closed positions, as illustrated at (1) and (2), respectively. For use as a waist belt, the belt 150 may include one single-sided or doubled-side belt strap, the latter enabling the belt strap to be reversible. For use as shoe or handbag straps, the belt 150 typically uses two single-side belt straps. Illustrated at (1), like the belt 100 shown in FIG. 1*a*, the at least one belt strap 170 of the belt 150 has a free end 161 portion and a fixed end 162 portion, the fixed end 162 portion is affixed to the belt buckle 180 around the center bar 154 in a similar way to that of the belt 100 around the end bar 103 of its belt buckle 130. The belt buckle 180 has a first outer end 171, a second outer end 172, and an inner end 173 at which the center bar 154 is located. The belt buckle 180 has an elongated buckle body 155, which has an opening being divided by the center bar 154 into two adjacent slots 152 and 153, bounded by side bar 157 and 158, respectively. As shown, the tip of the prong 156 stays on the side bar 157. The free end 161 portion is inserted through the belt buckle 180 first through the slot 152 from the inner side (or underside) to the outer side, with the prong 156 being inserted into a selected hole 165, extended over the center bar 154 and then back to the inner side through the slot 153, as illustrated at (2), resulting in a closed position of the belt 150. In this case, the slot 153 may be referred to as a lateral inner retainer loop. Although not shown at (2), using one double-sided belt strap 170 for reversability, the belt 150 may have a swingable type of prong 156 swung over to the side bar 158, and the free end 161 portion of the reversed belt strap 170 may be inserted through the belt buckle 180 first through the slot 153 from the underside to the outer side instead, with the prong 156 being inserted into a selected hole 165, extended over the center bar 154 and then back to the inner side through the slot 152, also acting like a lateral inner retainer loop in this case. Note that either the first outer end 171 and or the second outer end 172 of the belt buckle 180 may be used as outer end for the belt buckle 180.

Figure 1C:
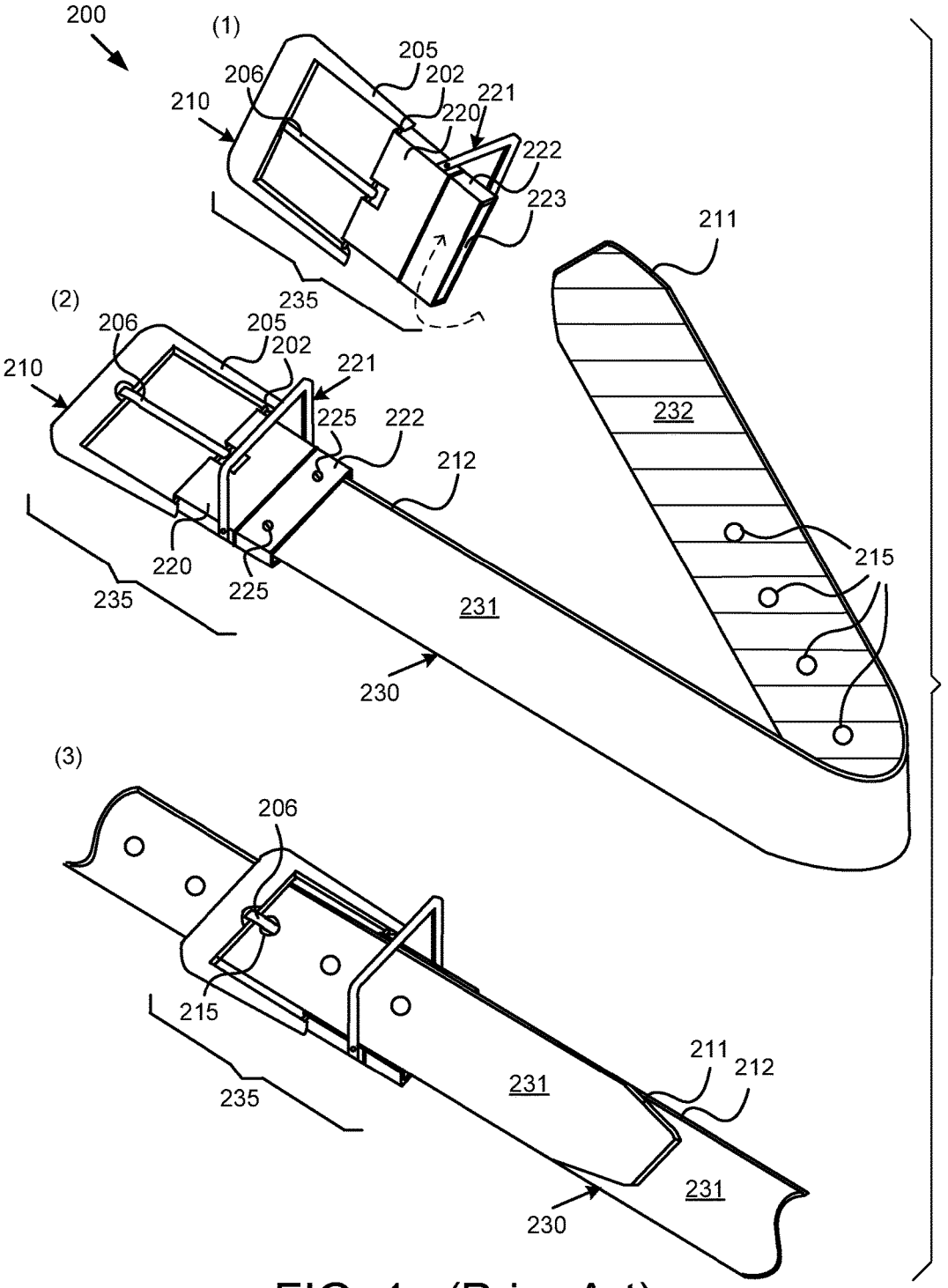
FIG. 1c (Prior Art)
FIG. 1*c* is a front perspective view of a conventional reversible waist belt including one double-sided belt strap with a frame-style belt buckle having a prong affixed thereto, a belt buckle connector, a rotatable belt reverser and a front inner retainer loop, in both open and closed positions.

FIG. 1*c* is a front perspective view of a conventional reversible waist belt 200 including one double-sided belt strap 230 with a frame-style belt buckle 210 having a prong 206 affixed thereto, a belt buckle connector 220, a rotatable belt reverser 222 and a front inner retainer loop 221, in both open and closed positions, as illustrated at (2) and (3), respectively. The belt strap 230 has side 1 231 (white face) and side 2 232 (black face shown in cross-hatched lines). The belt buckle (frame) 210, the belt buckle connector 220, and the rotatable belt reverser 222 attached thereto, and the front inner retainer loop 221 combined to form belt buckle assembly 235. The belt buckle 210 has a rectangular-shaped belt buckle body 205, an attached prong 206, and an end bar 202, bearing similarity to the belt buckle 130 of FIG. 1*a*.

A rear perspective view of the belt buckle assembly 235 is illustrated at (1), wherein the belt reverser 222 is shown to have a belt housing 223. A fixed end 212 terminal portion of the belt strap 230 is inserted into the belt housing 223 and is fastened to the belt reverser 222 from its outside with two screws 225, as illustrated at (2. In one embodiment, the end of this inserted belt strap has a short U-shaped cutout (not shown) used to allow each of this split belt strap end to straddle a short rotatable rod (not shown) inside the belt housing 223, which is extended toward and insertable into the belt buckle connector 220 through a hole thereof (not shown). In general, the belt reverser 222 and the belt buckle connector 220 may be rotatably attached to each other by any suitable arrangement, such as a rivet or eyelet (not shown). By pulling the belt reverser 222 outwardly and rotating it by 180° while holding on to the belt buckle connector 220, the two-sided belt strap 230 can be turned over, so that side 2 232 will be visible in the front (not shown) in place of side 1 231. Thus, either side of the belt strap 230 may be selected by the wearer to be visible when worn.

Like the belt 100, the belt 200 has five adjusting holes 215 for the prong 206 to choose from. The manner of fastening a free end 211 portion of the belt strap 230 and the fixed end 212 portion of the belt strap 230 together is similar to that of the belt 100 of FIG. 1*a* illustrated at (3) therein, except that the inner retainer loop 221 herein takes the place of the keeper 108 in a way. The closed position of the belt 200 after being fastened is illustrated at (3) herein, where the prong 206 is seen inserted into the selected adjusting hole 215 by the wearer.

Figure 1D:
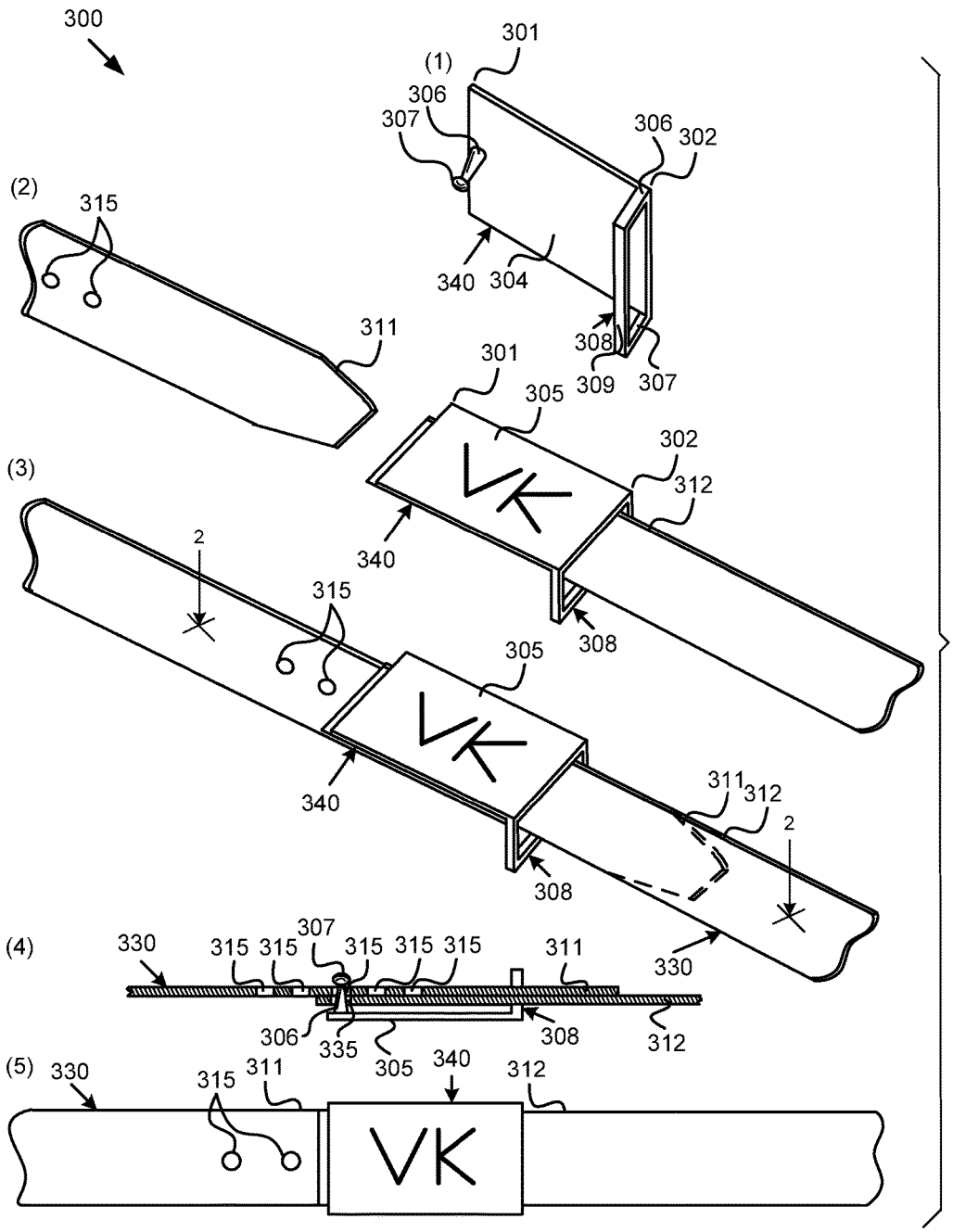
FIG. 1d (Prior Art)
FIG. 1*d* is a front perspective view of a conventional reversible waist belt including one double-sided belt strap with a removable plate-style belt buckle having a rear inner retainer loop, in both open and closed positions.

FIG. 1*d* is a front perspective view of a conventional waist belt 300 including one double-sided belt strap 330 with a removable plate-style belt buckle 340 having a rear inner retainer loop 308, in both open and closed positions, as illustrated at (2) and (3). The belt buckle 340 has a front face 305, which has the two ornamental characters V and K, and a plain rear face 304, which is illustrated in a rear perspective view of the belt buckle 340 at (1). On the rear face 304 adjacent its edge at an outer end 301, a projection 306 with an enlarged head 307 is located at a mid-point widthwise, which is usually an integral part of the belt buckle 340. The projection 306 is also referred to as peg, stud, and hook, the latter being configured accordingly. Also shown is the inner retainer loop 308, which includes two spaced legs 306 and 307 perpendicularly mounted on the rear face 304 at an inner end 302 and joined by a transverse cross bar 309. The legs 306 and 307 are in vertical alignment and parallel to each other and perpendicular to the cross bar 309. The cross bar 309 extends between the portions of legs 306 and 307 remote from the belt buckle rear face 304, thereby forming a loop structure for the retainer loop 308.

As illustrated at (2), the belt strap 330 has a free end 311 portion and a fixed end 312 portion. The free end 311 portion of the belt strap 330 has longitudinally spaced adjusting holes 315 at one inch interval. The fixed end 312 portion of the belt strap has one attachment hole 335 as shown at (4), which is inserted into by the projection 306 with the enlarged head 307 as the fixed end 312 portion of the belt strap is passed underneath the belt buckle's front face 305 all the way from the inner end 302 through the inner retainer loop 308 toward and extended beyond the outer end 301 for a short distance, as illustrated at (2). Thus, the fixed end 312 portion of the belt strap 330 is attached to the belt buckle 340, making it removable or, in other words, the belt buckle 340 removable.

With reference to the illustration at (3), to fasten the belt 300, the free end 311 portion is passed from the outer end 301 through the belt buckle's 340 rear face 304 from underneath and extended through the inner retainer loop 308 and beyond the inner end 302, underlapping the fixed end 312 portion of the belt strap 330 (with the free end 311 shown with dotted lines), and along the way the selected adjusting hole 315 is inserted into by the projection 306 with the enlarged head 307 underneath the fixed end 312 portion, which can be best seen in illustration at (4), as descried below.

Illustrated at (4) is a sectional view taken substantially along the line 2-2 of the illustration at (3), with the belt buckle 340 being turned upside down. As shown, the projection 306 with the enlarged head 307 is inserted into the attachment hole 335 in the fixed end 312 portion of the belt strap 330 and at a higher point inserted into the selected adjusting hole 315 of the free end 311 portion of the belt strap 330. Both belt strap portions are passed through the retainer loop 308 and extended beyond the inner end 302 to the right, with the free end 311 portion ending up being behind the fixed end 312 when viewed from the front in a normal closed position. As inferred from the illustration at (4), the belt buckle 340 is removable from the belt strap 330, and then the belt strap 330 may be turned over 180° and re-inserted into the belt buckle 340, so that either side of the belt strap 330 may be made visible in a front view. A front view of the belt 330 in closed position is illustrated at (5), which is how the belt 300 normally appears on the wearer as seen by the viewer, with the free end 311 portion hidden behind the fixed end 312 portion. A significant number of custom-made belt buckles with various designs, configuration and shapes follow this style.

Figure 1E:
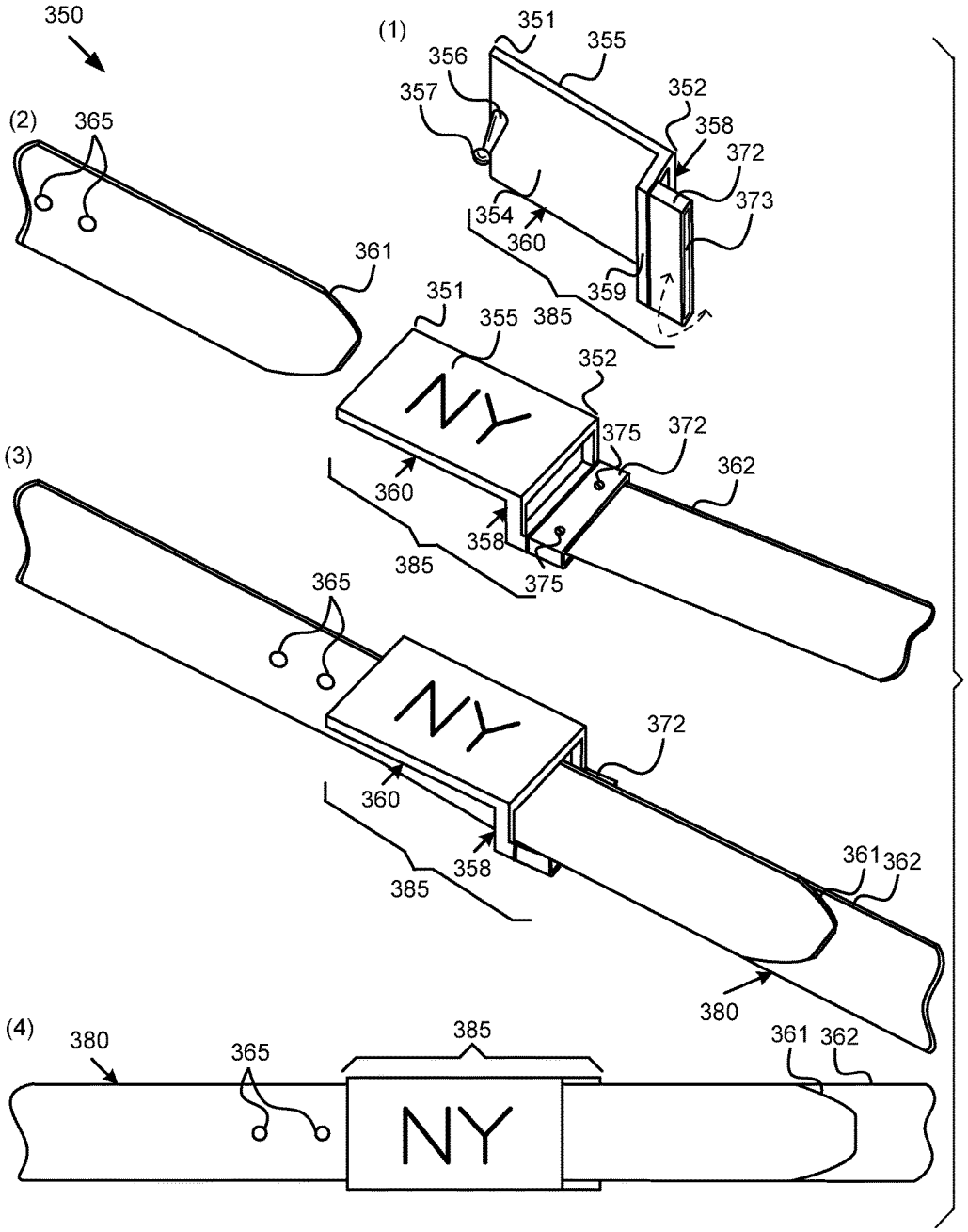
FIG. 1e (Prior Art)
FIG. 1*e* is a front perspective view of a conventional reversible waist belt including one double-sided belt strap with a plate-style belt buckle having a rear inner retainer loop and a rotatable belt reverser attached to the base thereof, in both open and closed positions.

FIG. 1*e* is a front perspective view of a conventional reversible waist belt 350 including one double-sided belt strap 380 with a plat-style belt buckle 360 having a rear inner retainer loop 358 and a rotatable belt reverser 372 attached to the base thereof, in both open and closed positions, as illustrated at (2) and (3), respectively. The belt buckle 360, the rear inner retainer loop 358 and the belt reverser 372 form a belt buckle assembly 385. The front face 355 has two exemplary ornamental characters N and Y. The rear inner retainer loop 358 located at an inner end 352 resembles that of the belt buckle 340 shown in FIG. 1*d*, each of which is used to receive the belt strap's free end. However, the cross bar 359 of the inner retainer loop 358 is attached to the belt reverser 372, as illustrated in a rear perspective view of the belt buckle assembly 385 at (1). Also depicted therein are additional items not visible in the front view such as a rear face 354 and a projection 356 with an enlarged head 357 located adjacent an outer end 351, like those of the belt buckle 340 shown in FIG. 1*d*. The functions and structure of the belt reverser 372 and its attachment relationship with the cross bar 359 are substantially similar to those of the belt reverser 222 and its attached belt connector 220 shown in FIG. 1*c*. The belt strap 380 has a free end 361 portion and a fixed end 362 portion, and the free end 361 portion of the belt strap 380 has adjusting holes 365. Description of illustrations at (2) and (3) is essentially a repetition of those of FIG. 1*c*, with the projection 356 replacing the prong 206 and the rear inner retainer loop 358 replacing the front inner retainer loop 222, and therefore is not repeated herein. The end result of a belt fastening for the belt 350 is illustrated at (4), as seen by the viewer, wherein the free end 361 portion is visible.

Figure 1F:
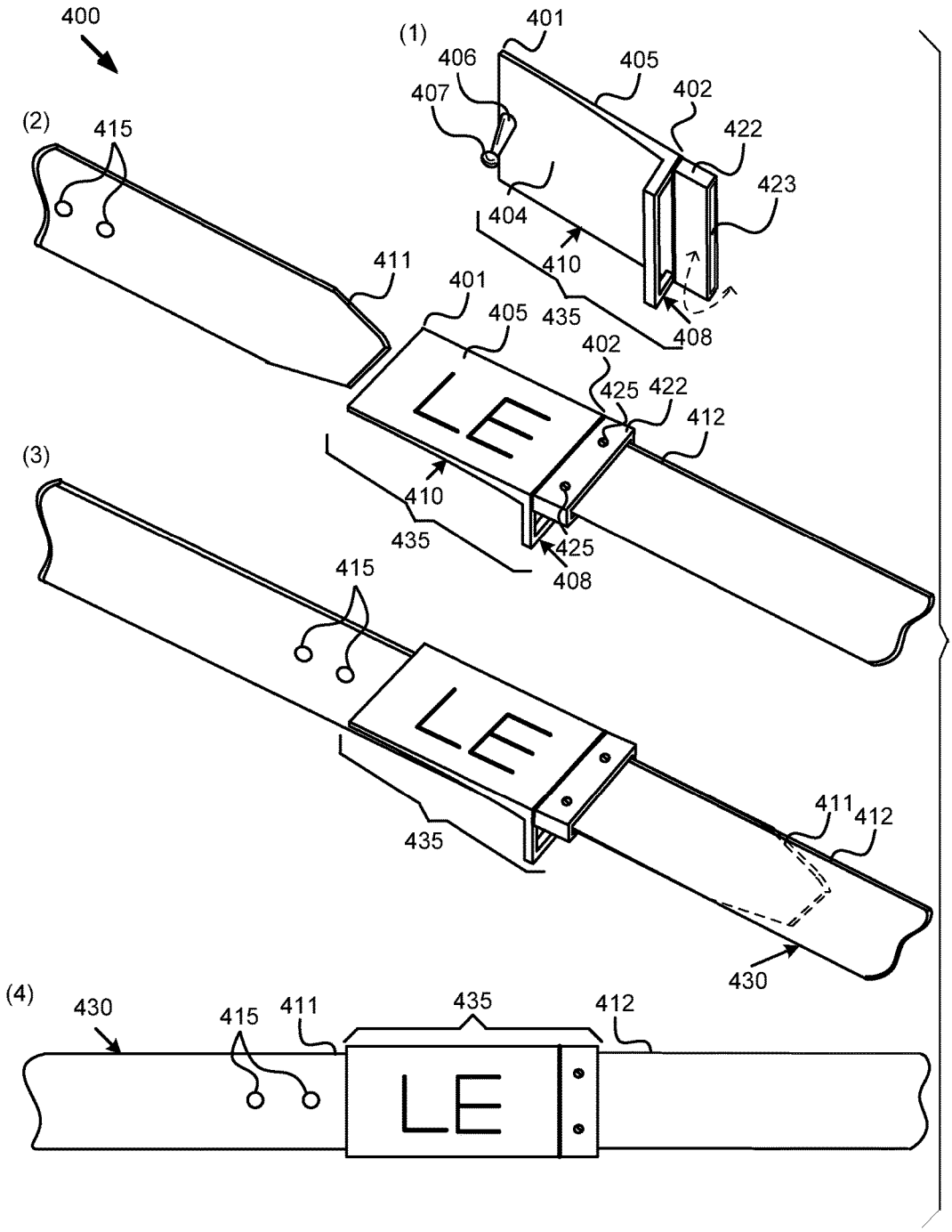
FIG. 1f (Prior Art)
FIG. 1*f* is a front perspective view of a conventional reversible waist belt including one double-sided belt strap with another plate-style belt buckle having attached thereto a rotatable belt reverser and a rear inner retainer loop thereunder, in both open and closed positions.

FIG. 1*f* is a front perspective view of a conventional reversible waist belt 400 including one double-sided belt strap 430 with another plate-style belt buckle 410 having attached thereto a rotatable belt reverser 422 and a rear inner retainer loop 408 thereunder, in both open and closed positions, as illustrated at (2) and (3), respectively. The belt buckle 410, the rear inner retainer loop 408 and the belt reverser 422 form a buckle assembly 435, similar to the buckle assembly 385 of FIG. 1*e*. A rear perspective view of the belt buckle assembly 435 is illustrated at (1) herein, wherein additional items not visible in the front view are a rear face 404 and a projection 406 with an enlarged head 407 adjacent an outer end 401. Description of illustrations at (1) through (3) herein is essentially a repetition of that of FIG. 1*e*, and therefore is not repeated herein. The end result of belt fastening for the belt 400 as seen by the viewer is illustrated at (4), wherein the free end 411 portion is not visible.

Figure 2A:
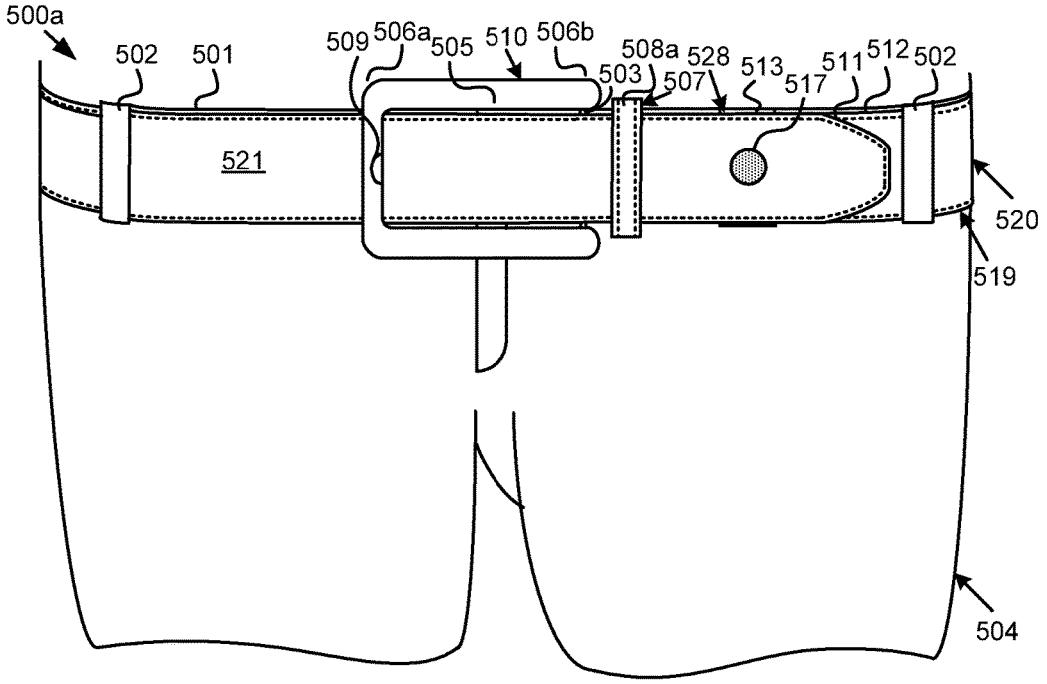
FIG. 2*a* is a front elevational view of a waist belt attachment system illustrating one embodiment of attaching a reversible waist belt to a garment such as trousers in closed position in accordance with the present invention.

FIG. 2*a* is a front elevational view of a waist belt attachment system 500*a* illustrating one embodiment of attaching a reversible waist belt 520 to a garment such as trousers 504 in closed position in accordance with the present invention. The description of the waist belt attachment system 500*a* refers to elements of FIG. 1, like numbers referring to like elements. Hereinafter, front ("something") is generally referred to as the part seen by the viewer and rear ("something"), the part seen by the user (wearer) and not the viewer unless otherwise noted. In the depicted embodiment, the waist belt attachment system 500*a* includes trousers 504 (shown in a fragmentary view), and a reversible waist belt 520. The trousers 504 include a waist band 501, around which individual belt loops 502 are sewn on. The waist belt 520 is attached to the waist band 501 through the belt loops 502. The waist belt 520 includes one double-sided belt strap 519, a frame-style belt buckle 510, a reversible keeper 507, and a removable belt clip 528 together with belt fasteners (not visible) forming belt fastening means. The belt strap 519 with edge stitches all around has two sides: side 1 521 (white face) and side 2 522 (black face, not exposed). Like the belt strap 120 used on a conventional belt 100 of FIG. 1*a* discussed previously, the belt strap 519 consists of two portions referred to as free end 511 and fixed end 512. The terminal portion of the fixed end 512 is attached to the belt buckle 510 by folding the same back around the end bar 503 of the belt buckle 510 and releasably securing to itself. Note that the conventional counterpart of the belt strap 120 is fixedly secured to itself with stitches. Unlike the belt strap 120, which has adjusting holes 115, the belt strap 519 has no adjusting holes. The keeper 507 has two half loops sewn together at two ends to form a single loop (with stitches hidable inside the loop), with its side 1 508*a*, white face, matching the belt strap side 1 521, and its side 2 508*b* (not exposed), black face, matching the belt strap side 2 522. Each said belt loop 502 receives therethrough the free end 511 portion of the belt strap 519 to hold the same in parallel relation to the fixed end 512 portion of the belt strap 519.

Figure 2B:
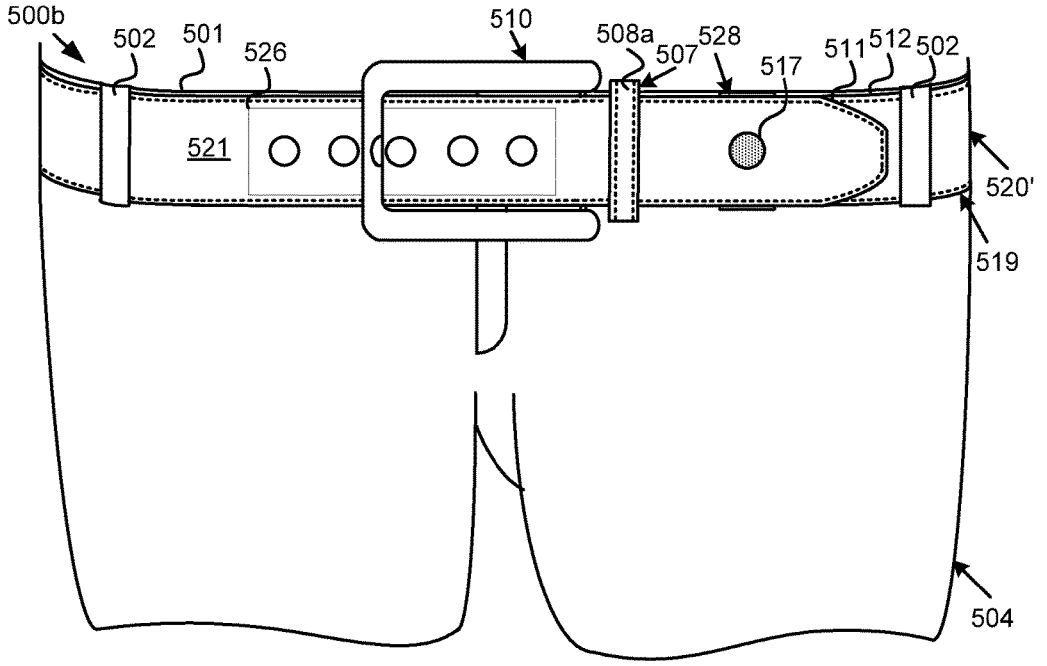
FIG. 2*b* is a drawing of a belt attachment system duplicated from FIG. 2*a*, except for the addition of an ornamental strip superimposed on each side of the belt strap, mimicking the traditional belt look in accordance with one embodiment of the present invention.

The belt buckle 510 resembles the conventional belt buckle 130 of FIG. 1*a*, except that the belt buckle 510 has no prong like the prong 106 of the belt buckle 130. Although unnecessary, like the counterpart on the belt buckle 130, the belt buckle 510 herein is provided with a semi-circular notch 509 on a side bar at its outer end 506*a*, so as to mimic a traditional belt buckle look even without a prong, especially notable when a waist belt attachment system 500*b* shown in FIG. 2*b* is provided. However, with the free end 511 portion threading through the belt buckle 510 from underneath as usual, without any support the elongated belt buckle body 505 would be dangling at the outer end 506*a*. To avoid such dangling, a rear outer retainer loop 530 as shown in FIG. 2*d* is provided on the rear side of the belt buckle body 505 adjacent the outer end 506*a*. Thus, the free end 511 portion begins threading through the belt buckle 510 through the rear outer retainer loop 530 first. In one embodiment, this rear outer retainer loop 530, invisible from front view of the belt buckle 510, may be constructed as integral piece of the belt buckle 510. The structure of the rear outer retainer loop 530 is similar to that of the rear inner retainer loop 308 of the conventional belt buckle 340 shown in FIG. 1*d*. Note that this kind of rear outer retainer loop is provided on other types of belt buckle to be described as well, with the exception of a frame-style belt buckle having a center bar such as shown in FIG. 4*b*, wherewith said dangling does not occur, even in the absence of a prong.

As well known, contemporary conventional belt buckles are used not only for fastening trousers (or shoes), for example, by necessity, but also as fashion and trend-setting accessories, self-expression and communication pieces, and emblems of nationalism, as well as for well-established military, religious, sports purposes and so on. The foregoing discussion indicates that the belt buckle 510 has no prong, and the belt strap 519 has no adjusting holes, the two items being shown with the conventional waist belt 100, for example, for use in fastening its free end 111 portion and fixed end 112 portion of the belt 100 together. The belt buckle 510 herein and other types of popular belt buckles described in following sections are used for all but belt fastening purposes, thus only retaining the traditional aesthetic appearance and all associated significance of the conventional belt buckles that have historically gained tremendous popularity for use in belts for a long time.

As an alternative to conventional way of waist belt fastening, in general, a different belt fastening means provided herein uses a stationary first fastening element affixed on one end (free end 511 or fixed end 512) portion of the belt strap 519 at an arbitrarily selected point and a mating, co-acting second fastening element affixed on front outer surface of the belt clip 528 engaging the opposite end (fixed end 512 or free end 511, respectively) portion lockedly, with the belt clip 528 being adjustably slidable along the belt strap 519. As well known, a variety of belt clips with locking mechanisms includable are commercially available in use on carrying cases (or holsters) for attaching objects such as cellular telephone, smartphone, small firearms to waist belts worn by the wearers. Unfortunately, the locking mechanisms on those belt clips are complex, some spring-loaded, expensive to build and lacking user-friendliness.

For example, a self-locking belt clip made by Nite Ize Inc. known as eCLIPse has multiple interacting members, which may include a tongue on one member and biasing mechanism on another, and a pressing surface. Although it provides auto-locks, the construction of this device is complex, and its cost can be high. Furthermore, despite a claimed quick-release feature, it is not easy to release the clip. On the other hand, the two-leaf belt clip 528 provided herein has met certain selection criteria such as simplicity in structure, adjustable slidability, self-locking, and ease of operation. The belt clip 528 is a single-piece spring clip, has an inward portion usable for clipping over the wearer's belt 520 against the waist band 501 of the wearing trousers 504 for the entire width of the belt strap 519, locks the engaged portion of the belt strap 519 in place, but is manually slidable longitudinally along its belt strap 519 such as by hand with a slight force. Thus, the belt clip 528 provides unlimited desired belt size adjustability without clip release or reengagement, to align with the first fastening element for fastening the two fastening elements to each other, thereby fastening the belt 520.

In a preferred embodiment, the first fastening element is placed on the free end 511 portion of the belt strap 519, and the second fastening element carried by the belt clip 528 is attached to the opposite end, namely fixed end 512, portion of the belt strap 519. In one embodiment, snap fasteners are chosen as fastening elements. For a reversible waist belt such as the belt 520, the first fastening element uses double-sided snap fasteners. As shown, a removable decorative cap 517 is placed over a snap fastener (not shown) on the belt strap free end 511 portion at a midpoint widthwise on side 1 521, so that the snap fastener lying underneath is not visible. The double-sided counterpart snap fastener located on side 2 522 (not visible) is to be fastened to the mating snap fastener (not visible) attached to the first leaf 513 of the belt clip 528, which slidably engages and then locks the engaged belt strap fixed end 512 portion in place, once an alignment is made between the two fastening elements.

Figure 2C:
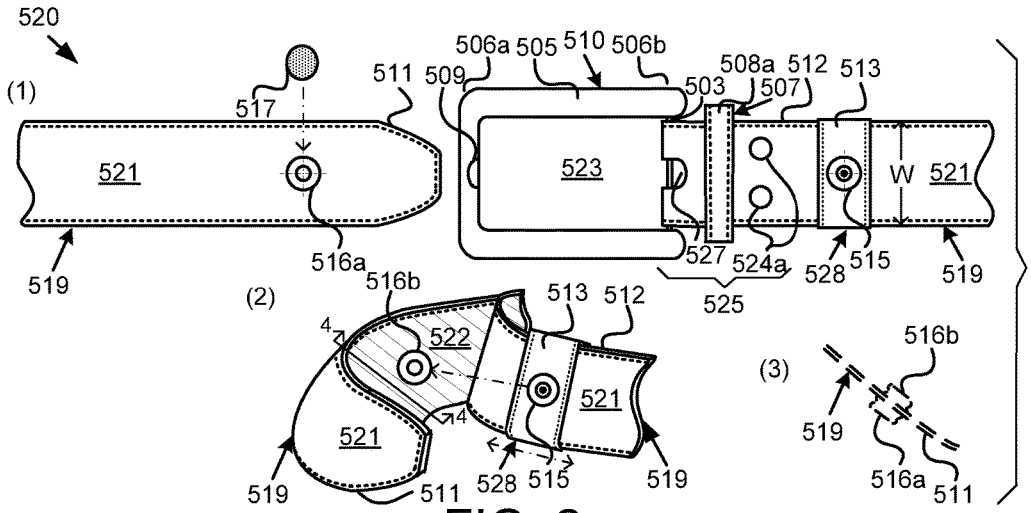
FIG. 2*c* is a fragmentary elevational view of the belt of FIG. 2*a* positioned to be assembled by the wearer in accordance with one embodiment of the present invention.
Figure 2D:
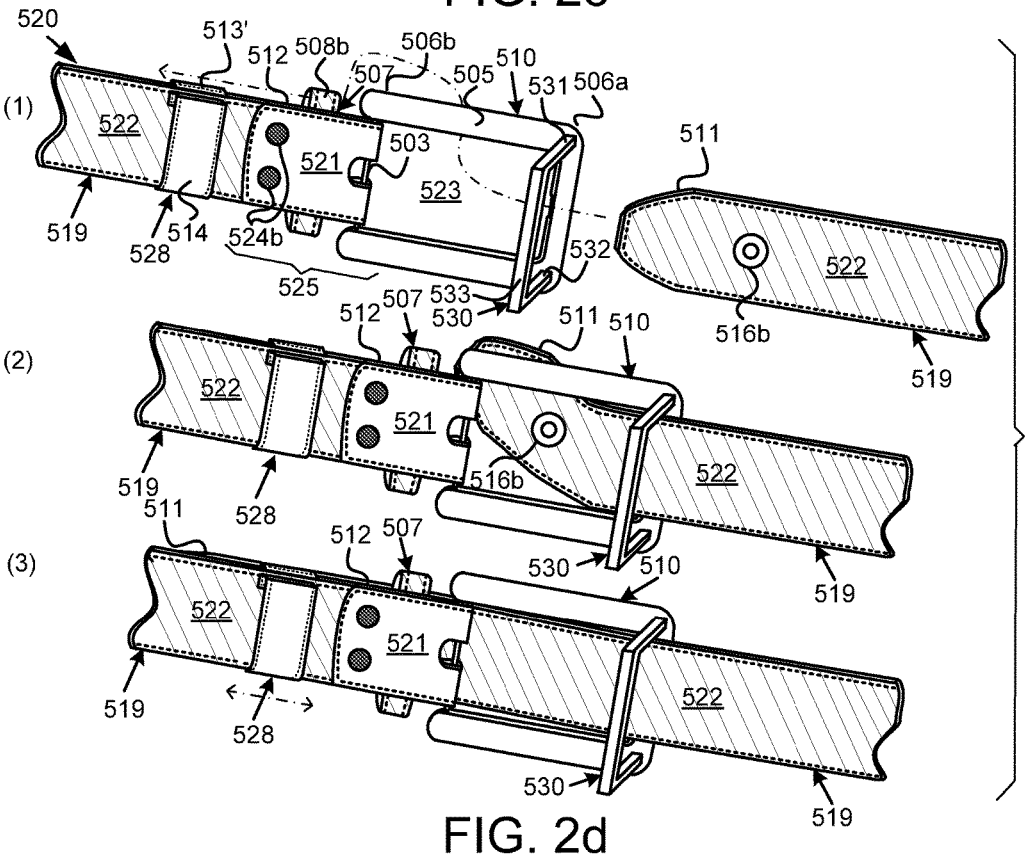
FIG. 2*d* is a fragmentary rear perspective view of the belt of FIG. 2*a* illustrating one embodiment of belt assembling operation by the wearer in accordance with the present invention.

This location arrangement of the fastening elements of FIG. 2*a*, best seen in FIG. 2*c* at (1), makes the presence of the belt clip 528 least conspicuous, with only the top edge and the bottom edge of the belt clip 528 visible as viewed from front when the belt 520 is placed in closed position. Note that for the belt 520 as shown, if locations of the two fastening elements are interchanged, so that the belt clip 528, which has the second fastening element attached to its first leaf 513 is placed on the free end 511 portion with the first leaf 513 facing rearward, then the belt clip 528 is more conspicuous, which may be camouflaged, if desired, with a suitable removable decorative slip-on belt clip cover usable on either side of the belt strap 519. The decorative cap 517 shown may be removed to be place on the opposite side 522 of the belt strap 519 when reversed. Detailed discussion of the structure, functionality, and slidability of the belt clip 528 and the second fastening element location thereon is deferred to the description of FIGS. 2*e*. and 2*f*.

FIG. 2*b* is a drawing of a belt attachment system 500*b* duplicated from FIG. 2*a*, except for the addition of an ornamental strip 526 superimposed on each side of the belt strap 519, mimicking the traditional belt look in accordance with one embodiment of the present invention. The description of FIG. 2*b* refers to elements of FIGS. 1 and 2*a*, like numbers referring to like elements. As depicted, a belt 520' is attached to the belt attachment system 500*b* and the belt 520' has the same parts as the belt 520, except for the addition of the ornamental strip 526. Although not visible, the strip 526 is duplicated on the opposite side of the belt strap 519, so that when the waist belt 520' is reversed with side 2 522 exposed, the same look is provided. The strip 526 is transparent, with its imprinted circles colorable, to simulate the looks of adjusting holes punched through a belt strap such as those holes 115 in the conventional belt 100 of FIG. 1*a*.

Figure 2E:
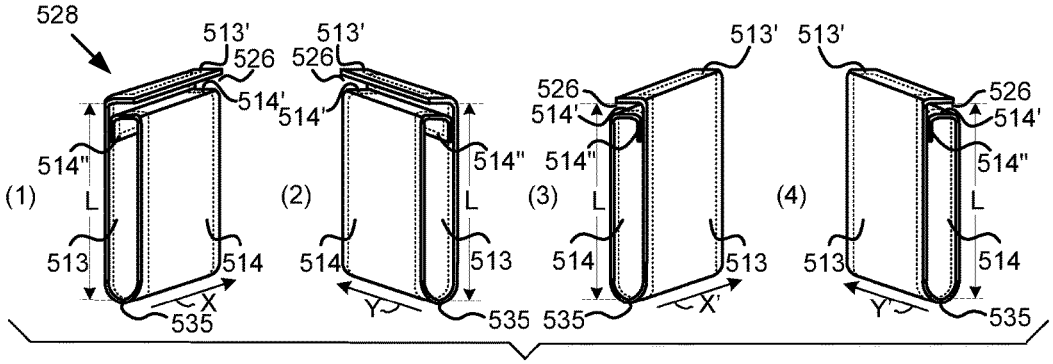
FIG. 2*e* represents exploded perspective views of the belt clip of FIG. 2*a* as seen by the viewer and the wearer, respectively, in accordance with one embodiment of the present invention.

In ensuing sections, FIGS. 2*c* and 2*d* show the locations of additional hidden parts of the belt 520, including belt fastening elements, and illustrate a belt assembly operation by the wearer to end up with the closed position illustrated in FIG. 2*a*. FIG. 2*g* illustrates a removal operation of the belt clip 528 from the belt strap 519 before the belt strap 519 is turned over for side 2 522 to be selected to be visible by the wearer. FIG. 2*h* illustrates re-insertion of the belt strap 519 into the inside of the belt clip 528 by the wearer following the turn-over of the belt strap 519. FIG. 2*i* illustrates the reversed belt 520" in open position from a viewer's point of view. FIG. 2*j* shows the belt attachment system 500*c* with the attachment of the reversed belt 520" in closed position from a viewer's point of view.

FIG. 2*c* is a fragmentary elevational view of the belt 520 of FIG. 2*a* positioned to be assembled by the wearer in accordance with one embodiment of the present invention. The description of FIG. 2*c* refers to elements of FIGS. 1 and 2*a*-2*b*, like numbers referring to like elements. Illustrated at (1) is open position of the belt 520, showing parts hidden from view in FIG. 2*a*, herein viewable by the viewer. As depicted, a keeper assembly 525 includes a foldback subportion of the fixed end 512 portion, the keeper 507, two snap fasteners 524*a*, which are mounted on the belt strap fixed end 512 portion and fastened to their disengageable mating snap fasteners 524*b* disposed on the foldback subportion as shown in FIG. 2*d* at (1). The keeper 507 is confined inside the keeper assembly 525 once the snap fasteners 524*a* and 524*b* are fastened together. To the left of the keeper assembly 525, an open space 523 is created by the belt buckle body 505. Even though the belt buckle 510 has no prong, to the left of the keeper 507, a U-shaped cutout 527 on the fixed end 512 portion is provided over the center of the end bar 503 of the belt buckle 510. Although unnecessary, the cutout 527 may be used to accommodate a prong like the prong 106 of the conventional counterpart belt buckle 130 of FIG. 1*a*, but with its tail end 107 replaced with a removable R-shaped clip (both not shown herein). The sole purpose for having this kind of prong is to allow the belt buckle 510 to be displayed on a retail outlet rack like a familiar conventional belt buckle 130, so that a consumer unfamiliar with the appearance of the new belt buckle 510 does not suspect the belt buckle 510 has a missing part or is defective. However, an instructional note needs to be attached to such prong of the belt buckle 510 such as saying "remove before use". Hereinafter the cutout 527 will be completely ignored in terms of functional and structural description of any belt provided in accordance with the present invention as if it had not existed (even though some drawings still include it).

Also illustrated at (1) are snap fastener 516*a* disposed on the belt strap side 1 521 at the midpoint widthwise adjacent the tip of the free end 511 and its mating snap fastener 515 disposed on the first leaf 513 of the belt clip 528 at a corresponding position. Speaking of the width of the belt strap 519, it is indicated as W. To determine said corresponding position on the belt clip 528, a quick way is to assume that the belt clip 528 may take on a U shape and the lower edge of the engaged belt strap settles down at the lowest point inside a U-shape bend of the belt clip 528. Measured from the lowest point on the outer surface of the belt clip 528, which is held in a vertical upright orientation, a point thereon at a height of ½ W can be obtained and a horizontal line can be drawn across said outer surface. The midpoint of the line may be a candidate for said corresponding position. To account for the thicknesses of coverings that need to be provided for the belt clip 528, the candidate's position needs to be raised up slightly. A more precise determination of a center of the first leaf 513 will be discussed in a subsequent section. In one embodiment, the length L of the belt clip 528 as measured from the highest point to the lowest point within its inner surface areas with sewn-on coves, as shown in FIG. 2*e*, is set to be equal to W for reasons to be explained later. The decorative cap 517 may be placed over the snap fastener 516*a* with side 1 521 visible as shown or the snap fastener 516*b* when side 2 522 (shown in FIG. 2*i*) is made visible.

Note that in depicted embodiments, the belt clip 528 has an outer cover placed over its entire outer surface and an inner cover placed over its entire inner surface with edge stitches, indicating that the covers are sewn together, much like the counterpart used on contemporary cellular telephone case, so that the surface of the engaged portion of the belt strap 519 may be protected from deep scraping by the belt clip 528. The outer cover also allows the second fastening element to be secured thereon. The cover material may be leather, vinyl or other suitable material. Snap fasteners 516*a* and 516*b* are double-sided snap fasteners as illustrated in FIG. 2*c* at (3) for a doubled-sided belt strap 519 in a side cross sectional view taken along the lines 4-4 of FIG. 2*c* at (2). To fasten the belt 520 after the free end 511 portion is threaded through and beyond the belt buckle 510, the snap fastener 515, which is attached to the outer surface of the first leaf 513 of the belt clip 528, is to be aligned with and fastened to the snap fastener 516*b* disposed on the underside, which is side 2 522, of the belt strap 519, as illustrated at (2) with a dashed-dotted line arrow. For this alignment, the belt clip 528 may be slid manually by hand to the right or to the left longitudinally along the belt strap 519 as needed, shown with dashed-dotted line arrows, which operation is more clearly illustrated in FIG. 2*f*. Black face of side 2 522 of the belt strap 519 is shown with cross-hatched lines.

Snap fasteners 516*a*, 516*b* and 515 may be of sewn-on type or press type with two prongs built in, for example. One skilled in the art is familiar with method and tool for installing these snap fasteners. In one exemplary embodiment, double-sided snap fasteners each with two prongs may be installed on the doubled-sided belt strap 519 using a special press tool, with one snap fastener's prongs spread out to the two sides within the layers of the belt strap 519 longitudinally and the other's, transversely. In certain embodiments, a fastener such as the snap fastener 515 may need to be installed on the belt clip's 528 cover before it is sewn onto the belt clip 528. Magnetic snap fasteners (not shown) may also be used, preferably with male parts installed on the belt strap 519 double-sided and the thicker female part installed on the outer surface of the first leaf 513 of the belt clip 528.

Note that in a preferred embodiment, the second fastening element required by belt fastening means herein, whatever the device may be, is installed on the belt clip 528 single-sided, such as on the outer surface of the first leaf 513 at its center, for example, for manufacturing cost savings. In an alternate embodiment, a fastener such as the snap fastener 515 may be installed at the center of the second leaf 514 of the belt clip 528 instead. A method of locating the center of a belt clip's 528 leaf is provided in the description of FIG. 2*e*. In one embodiment, with a single-sided fastener installed on the belt clip 528, before the belt strap 519 is reversed for the underside to be visible for the reversible belt 520, the belt clip 528 needs to be removed therefrom and reinserted in the same orientation after the belt strap 519 is reversed. In an alternate embodiment, the second fastening element may be duplicated on the outer surface of the second leaf 514 of the belt clip 528, so that following a turnover of the belt strap 519 to expose the underside without removing the belt clip 528 therefrom first and then re-inserting, the belt clip 528 is in an inverted position, but still operable as usual. Thus, removal and reinsertion of the belt clip 528 become unnecessary.

FIG. 2*d* is a fragmentary rear perspective view of the belt 520 of FIG. 2*a* illustrating one embodiment of belt assembling operation by the wearer in accordance with the present invention. The description of FIG. 2*d* refers to elements of FIGS. 1 and 2*a* through 2*c*, like numbers referring to like elements. FIG. 2*d* shows rear view of the belt 520 of FIG. 2*a* as seen by the wearer when undergoing individual phases of an assembling operation. At (1) the belt 520 is in open position, with a dotted-dashed line arrow indicating the path the free end 511 portion is to be inserted through the belt buckle 510 and so on. A rear outer retainer loop 530 disposed on the rear side of the belt buckle 510 adjacent the outer end 506*a* is shown. The insertion path starts with the free end 511 threading through the rear outer retainer loop 530, continues with the free end 511 portion extending outwardly through the open space 523 created by the belt buckle 510 toward an inner end 506*b*, as illustrated at (2), then through the keeper 507, and ends up with the free end 511 portion stopping at a desired distance beyond the belt buckle 510, with the snap fastener 515 on the belt clip 528 attempting to fasten onto the snap fastener 516*b*, as exaggeratedly illustrated in FIG. 2*c* at (2). The belt clip 528 needs to be slid along the belt strap 519 either toward or away from the belt buckle 510 for alignment with the snap fastener 516*b* first, depending on where the belt clip 528 is situated. The end result of the assembling operation of the belt 520 by the wearer is illustrated in FIG. 2*d* at (3).

Figure 2F:
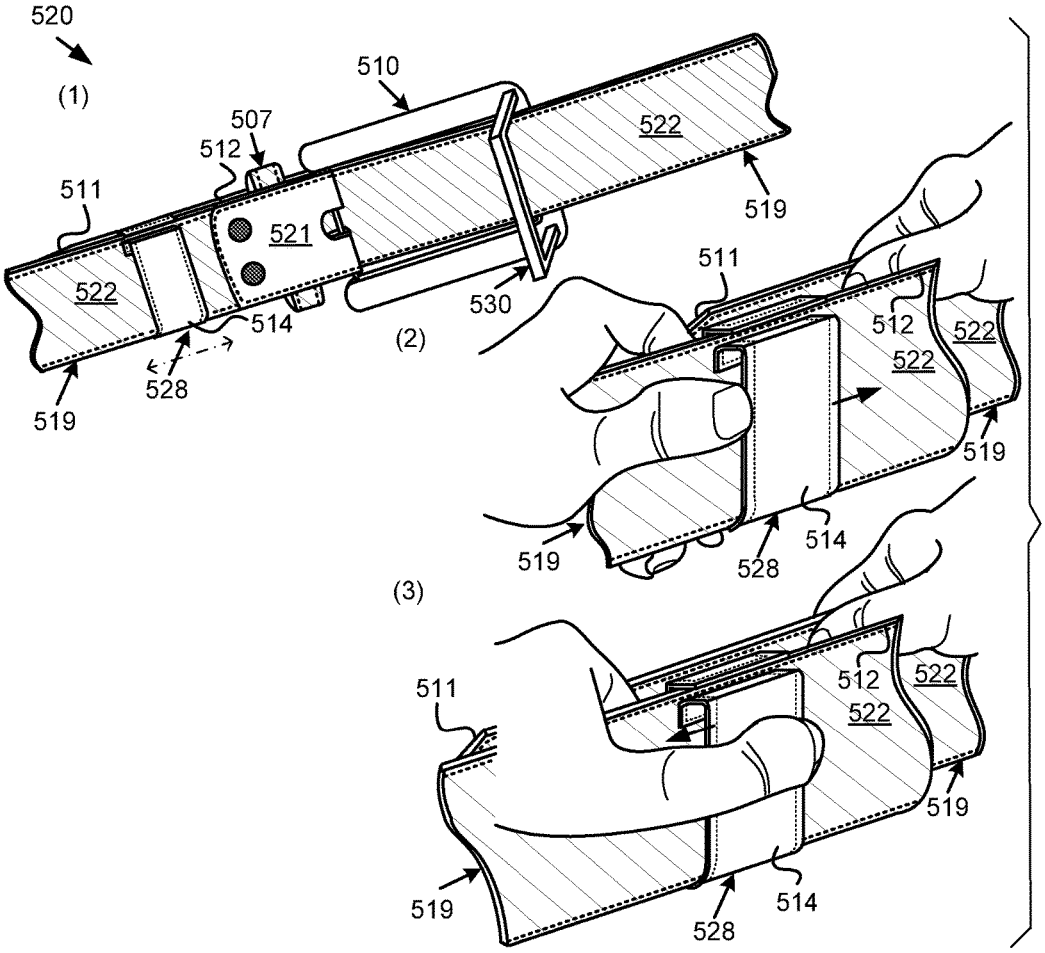
FIG. 2*f* is a fragmentary rear perspective view of the belt of FIG. 2*a* illustrating the manner of sliding operation of the belt clip thereof along a belt strap by the wearer in accordance with one embodiment of the present invention.
Figure 2G:
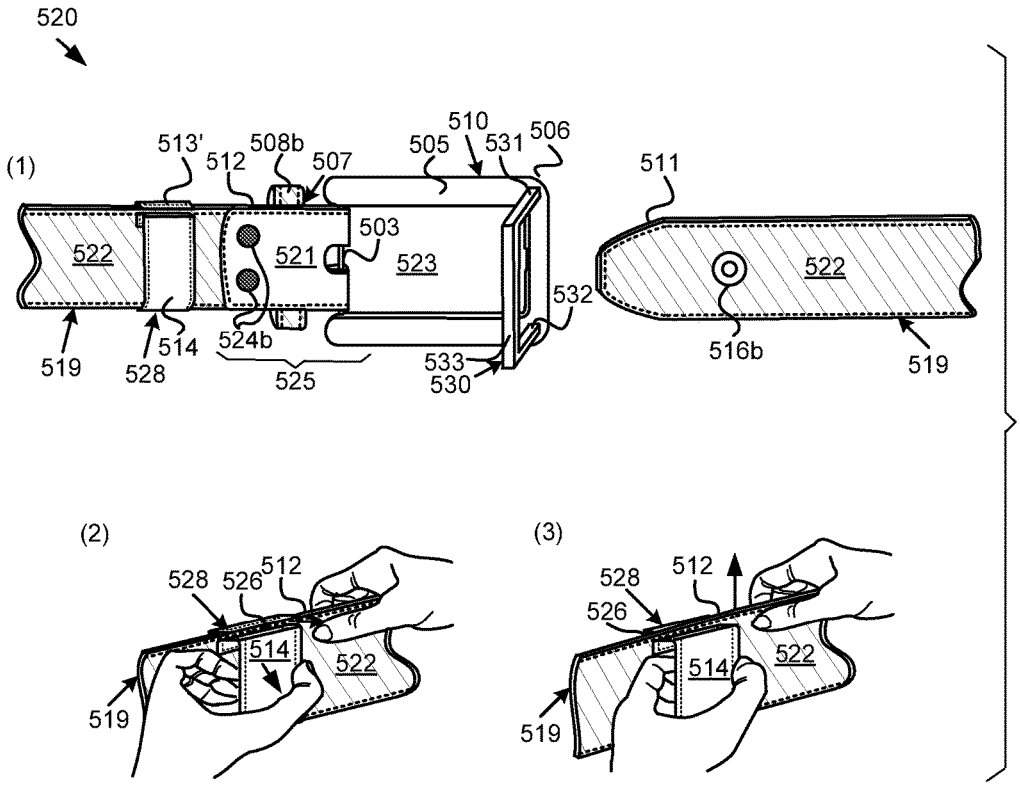
FIG. 2*g* is a fragmentary rear perspective view of the belt of FIG. 2*a* showing the manner of reversal of the belt strap thereof, starting with removal of the belt clip therefrom by the wearer in accordance with one embodiment of the present invention.
Figure 2H:
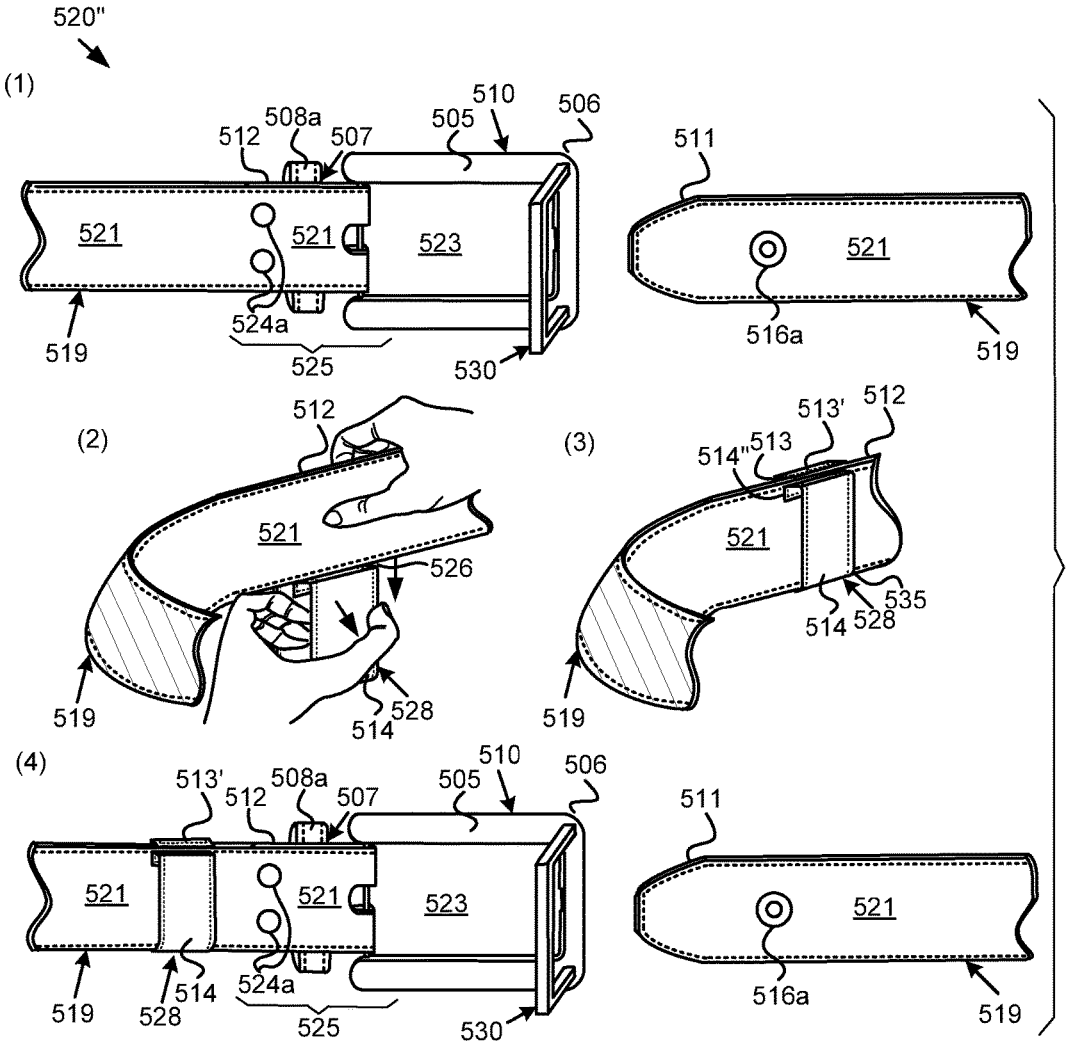
FIG. 2*h* is a fragmentary rear perspective view of a belt resulting from reversing that of FIG. 2*a* showing the manner of re-inserting the belt strap thereof into the belt clip by the wearer in accordance with one embodiment of the present invention.
Figure 2I:
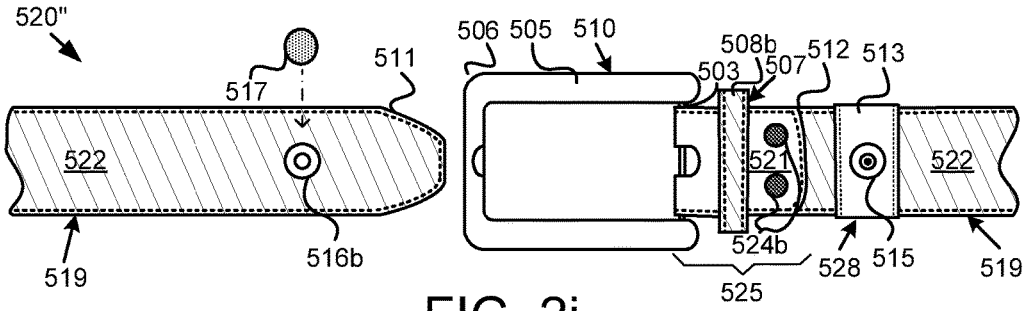
FIG. 2*i* is a fragmentary front elevational view of the reversed belt shown in FIG. 2*h* illustrating its open position in accordance with one embodiment of the present invention.
Figure 2J:
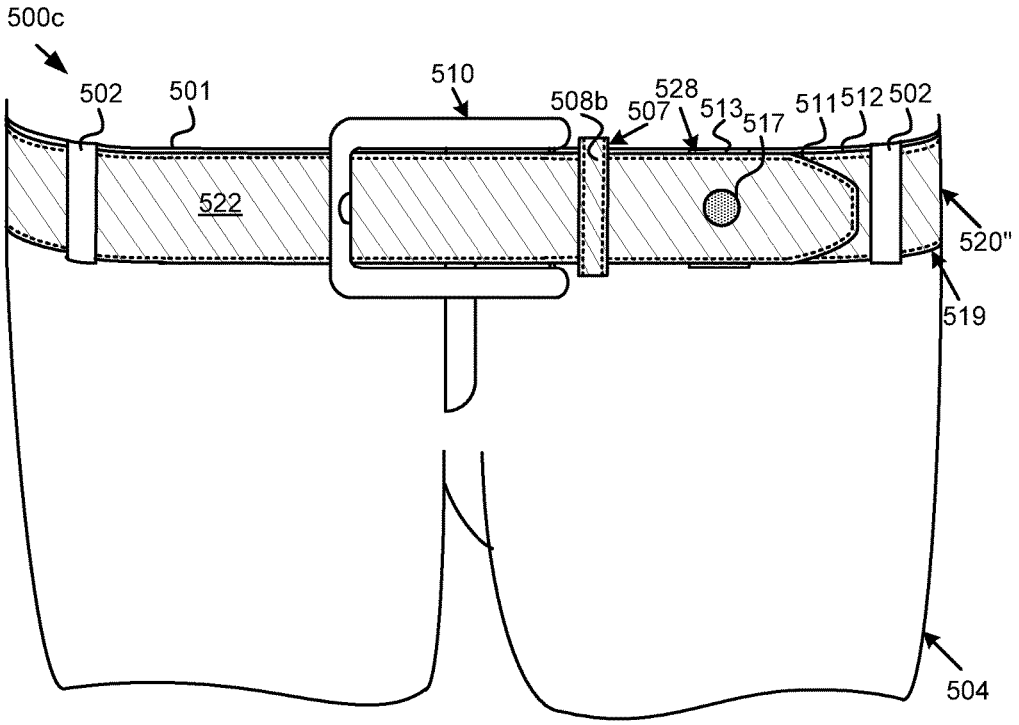
FIG. 2*j* is a front elevation view of a reversible belt attachment system illustrating one embodiment of attaching the waist belt of FIG. 2*i* to the garment such as trousers of FIG. 2*a* in closed position in accordance with the present invention.

As mentioned previously, for the belt clip 528 to align with the snap fastener 516*b* may require manual maneuver by the wearer for sliding the belt clip 528 to the right or to the left along the belt strap 519 depending on the relative position of the belt clip 528, which operation is best illustrated in FIG. 2*f*. Once the desired stop point of the free end 511 portion travel is well established for normal wear, the belt clip 528 may not need any further sliding. However, on certain occasion, after a heavy meal, for example, the wearer may need to loosen the belt 520 slightly by retracting the free end 511 a short distance following a belt unfastening, and as such, the belt clip 528 can be slid closer to the belt buckle 510 by hand accordingly, so that the belt 520 can be accommodatingly re-fastened. On the other hand, for a need to tighten the belt 520 slightly, the belt clip 528 may be slid farther away from the belt buckle 510 accordingly. Note that once manual sliding of the belt clip 528 is stopped, the belt clip 528 is lockedly engaging a portion of the belt strap 519, disallowing any relative movement of the belt strap 519 on its own.

By now it is clear that because of the absence of a prong as mentioned in foregoing discussion, the rear outer retainer loop 530 as illustrated in FIG. 2*d* at (1) is provided on the rear side of the belt buckle body 505 near the outer end 506 to receive the free end 511 portion firstly and prevent the belt buckle 510 from dangling after the free end 511 portion is threaded through the belt buckle 510. The rear outer retainer loop 530 includes a body having a slot formed therein by two spaced parallel legs 531 and 532 perpendicularly mounted on the rear periphery of the belt buckle body 505 and a transverse cross bar 533 joining said two legs at their other ends.

FIG. 2*e* represents exploded perspective views of the belt clip 528 of FIG. 2*a* as seen by the viewer and the wearer, respectively, in accordance with one embodiment of the present invention. The description of FIG. 2*e* refers to elements of FIGS. 1 and 2*a* through 2*d*, like numbers referring to like elements. The belt clip 528 is in the form of a U-shape unitary resilient spring clip made of metal such as steel, plastic or other suitable material, with metal being preferred for durability. As illustrated at (1) through (4), the belt clip 528 has equal-width first leaf 513 and second leaf 514, which are joined together to form a semi-circular concave bottom portion referred to as U-bend 535 at their lower ends. The exteriors of upper sections of the two leaves are substantially parallel. The lengths of the first leaf 513 and the second leaf 514 are approximately equal before inward portions are provided. At the top end, the first leaf 513 is provided with an inwardly extending portion referred to as cap 513', which serves to block the engaged belt strap 519 portion from moving upwardly once clipped over. The upper extremity of the second leaf 514 is provided with an inwardly extending portion referred to as plateau 514' and a downwardly extending transverse abutment portion referred to as abutment 514", which touches and leans on the inner surface of the first leaf 513.

The cap 513', the plateau 514' and the abutment 514" have the same width as that of the first leaf 513 or the second leaf 514, and each of their length may be 3/16 of an inch or less, for example, in a certain embodiment. A transverse gap (open space) defined between the cap 513' and the plateau 514' is a lateral belt strap entrance 526, which is large enough to accommodate the typical thickness of a double-sided belt strap such as the belt strap 519 for insertion of its lower edge into a forced opening of the belt clip 528. Following the insertion through the belt strap entrance 526, the lower edge of the belt strap fixed end 512 portion is inserted between the inner surface of the first leaf 513 and the outer surface of the abutment 514" all the way downwardly to the inside lowest point of the U-bend 535, which engages the lower edge of the inserted portion of belt strap 519. The inner surface of the cap 513' engages the upper edge of the inserted portion of the belt strap 519. Movement of the engaged portion of the belt strap 519 is opposed by frictional forces between the engaged portion of the belt strap 519 and the first leaf 513 and between the engaged portion of the belt strap 519 and the abutment 514". In one embodiment, the width of the belt clip 528 may be comparable to that of a contemporary cellular telephone case belt clip.

Illustrated at (1) is a perspective view of the belt clip 528 as seen by the wearer in the direction X, which is taken toward the belt buckle 510, as shown in FIG. 2*f* at (1). Similarly, illustrated at (2) is a perspective view of the belt clip 528 as seen by the wearer in the direction Y, which is away from the belt buckle 510. Likewise, illustrated at (3) is a perspective view of the belt clip 528 as seen by the viewer in the direction X', which is away from the belt buckle 510. Illustrated at (4) is a perspective view of the belt clip 528 as seen by the viewer, which is toward the belt buckle, as shown in FIG. 2*c* at (2), wherein the belt buckle 510 passed through by the free end 511 portion is actually located to the left of the belt clip 528.

In one embodiment, with a cover installed all around the belt clip 528 as discussed previously, the inside length L of the belt clip 528 as measured from the highest point at the inner surface of the cap 513' to the lowest point located at the center of the inner surface of the U-bend 535 is made substantially equal to the width W of the belt strap 519. Although a portion of the belt strap fixed end 512 stays inside of the belt clip 528 between the inner surface of the first leaf 513 and the outer surface of the abutment 514, the entire width of inserted belt strap 519 portion is captured inside the belt clip 528 from its upper edge to its lower edge with little or no clearance. The upper edge of the inserted belt strap 519 is substantially in contact with the inner surface of the cap 513'. Afterwards, the belt clip 528 does not permit relative movement of the belt strap 519 on its own, so that once fastened, the circumference of belt strap 519 around the waist is not allowed to be expanded even when the wearer sits down, for example. However, as shown in FIG. 2*f*, before belt fastening takes place, the belt clip 528 may be adjustably slid along the belt strap 519 by hand to align with the location of the first fastening element, snap fastener 516*b* in this case, which is fixedly disposed on the belt strap free end 511 portion on side2 522, as shown in FIG. 2*c* at (2).

In a preferred embodiment, to locate the center of the outer surface of the first leaf 513 of the belt clip 528, which is substantially a rectangle, have it imaginarily extended straight downwardly at its lower end to the lowest point of the belt clip 528 instead of curving into a U-bend, with the belt clip 528 placed in a vertical orientation. Then, a horizontal line may be drawn from the midpoint of one long edge of the resultant rectangle across to the other long edge and a vertical line may be drawn from the midpoint of one short edge of the rectangle across to the other short edge. The intersection of the two lines is the center of the rectangle or the center of the first leaf 513 outer surface. The second fastening element mentioned previously may be installed at this center point. To locate the center of the second leaf 514 outer surface for installing the second fastening element, a similar method may be taken to form a larger rectangle, except that the upper end of the straight part of the leaf 514 is imaginarily extended up to the same height as that of the leaf 513 (up to the cap 513') in addition to extending its lower end in the same manner as the first leaf 513.

FIG. 2*f* is a fragmentary rear perspective view of the belt 520 of FIG. 2*a* illustrating the manner of sliding operation of the belt clip 528 thereof along a belt strap 519 by the wearer in accordance with one embodiment of the present invention. The description of FIG. 2*f* refers to elements of FIGS. 1 and 2*a* through 2*e*, like numbers referring to like elements. Illustration at (1) is a duplication of the drawing FIG. 2*d* at (3), which shows the end result of the assembling operation on the belt 520. If the location of the belt clip 528 is too close to the tip end of the free end 511 portion, as illustrated in FIG. 2*f* at (2), the belt clip 528 is to be slid in the direction of the arrow, that is, to the right longitudinally (closer to the belt buckle 510). With the right hand holding the free end 511 portion and the left hand pushing the belt clip 528 in that direction, the wearer is able to achieve the desired alignment with a small amount of force for belt fastening, which calls for fastening the snap fastener 515 to the snap fastener 516*b*.

Similarly, as illustrated at (3) in FIG. 2*f*, wherein the location of the belt clip 528 is shown to be too far away from the tip end of the free end 511 portion, the wearer pulls with force the belt clip 528 in the direction of the arrow, that is, to the left longitudinally (farther away from the belt buckle 510) for the desired alignment and belt fastening. Note that because the entire width of the belt strap 519 fits perfectly (when L is set to equal W) inside the belt clip 528 from the upper edge to the lower edge, said sliding of the belt clip 528 to the right or to the left along the belt strap 519 does not cause the engaged belt strap 519 to be tilted to one side. Once the manual sliding is stopped, the belt clip 528 engages the belt strap 519 at a new longitudinal position and locks it in place, and belt fastening may thus be desirably accomplished. To unfasten the belt 520, the co-acting snap fasteners 516*b* and 515 need to be separated, and then the belt 520 may be unbuckled, and the free end 511 portion may be retracted out of the belt buckle 510 by the wearer to arrive at an open position such as illustrated in FIG. 2*d* at (1).

FIG. 2*g* is a fragmentary rear perspective view of the belt 520 of FIG. 2*a* showing the manner of reversal of the belt strap 519 thereof, starting with removal of the belt clip 528 therefrom by the wearer in accordance with one embodiment of the present invention. The description of FIG. 2*g* refers to elements of FIGS. 1 and 2*a*-2*f*, like numbers referring to like elements. As described previously, in a preferred embodiment, the second fastening element 515 disposed on the belt clip 528 is only on one side even in the case of a reversal of the reversible belt. Therefore, before the belt strap 519 is turned over so that side 2 522 is selected visible in the front by the wearer, the wearer unfastens and unbuckles the belt 520 first and then removes the belt clip 528 from the belt strap 519. Illustrated at (1) is the rear view of the belt 520 in open position, which is a duplicated illustration of FIG. 2*d* at (1). Illustrated at (2) of FIG. 2*g* herein is the first step of pulling the engaged belt strap's 519 upper edge (at least partly) out of the belt strap entrance 526 of the belt clip 528 with the wearer's right hand while pulling the second leaf 514 of the belt clip 528 outwardly toward the wearer by the left hand with force to make the belt clip 528 disengage said upper edge slightly. Then, the right hand starts its upward pulling of said upper edge of the belt strap 519 as illustrated at (3), and continues the upward pulling until the entire engaged belt strap 519 portion is removed from the belt clip 528 (not shown).

Alternatively, the belt clip 528 may be removed from the belt strap 519 by sliding the belt clip 528 all the way out of the free end 511 portion of the belt strap 519 completely (not shown) before the belt strap 519 is turned over. Once the belt clip 528 is removed from the belt strap 519, to turn over the belt strap 519, the wearer performs the following steps:

1. unfasten the snap fasteners 524*b* in the keeper assembly 525, which are shown at (1), from the snap fasteners 524*a* (not visible);
2. remove the foldback portion of the belt strap fixed end 512 from the end bar 503 of the belt buckle 510 shown at (1);
3. remove the keeper 507 from the keeper assembly 525;
4. turn over the belt strap 519 and fold the belt strap fixed end 512 terminal portion back around the end bar 503;
5. turn the keeper 507 over so that its black face 508*b* is now shown in the front, and reinsert the keeper 507 inside the keeper assembly 525 to the right of snap fasteners 524*b*; and
6. re-fasten the two pair of fasteners 524*a* and 524*b* together.

The end result of the above multi-step operation is illustrated in FIG. h at (1).

FIG. 2*h* is a fragmentary rear perspective view of a belt 520" resulting from reversing that of FIG. 2*a* showing the manner of re-inserting the belt strap 519 thereof into the belt clip 528 by the wearer in accordance with one embodiment of the present invention. The description of FIG. 2*h* refers to elements of FIGS. 1 and 2*a*-2*g*, like numbers referring to like elements. Illustrated at (1) is the reversed belt 520" without the belt clip 528 in open position, as seen by the wearer. The open space 523 created by the belt buckle 510 is re-shown. Illustrated at (2) is a re-insertion of the belt strap fixed end 512 portion with its lower edge first into the belt clip 528 at the belt strap entrance 526 thereof with the right hand while the second leaf 514 of the belt clip 528 is pulled outwardly toward the wearer to create an opening in the belt clip 528 with the left hand. Illustrated at (3) is the inserted portion of the belt strap 519 being completely placed within the inside of belt clip 528, with the belt strap's 519 upper edge substantially in contact with the inner surface of the cap 513' and the lower edge settled at the lowest point of the inner surface of the U-bend 535 of the belt clip 528. The rear view of the reversed belt 520" re-fitted with the belt clip 528 in open position is illustrated at (4). Note that the snap fastener 515 installed on the first leaf 513 (not visible) is positioned for alignment with the snap fastener 516*a* towards belt fastening following belt buckling.

FIG. 2*i* is a fragmentary front elevational view of the reversed belt 520" of FIG. 2*h* illustrating its open position in accordance with one embodiment of the present invention. The description of FIG. 2*i* refers to elements of FIGS. 1 and 2*a*-2*h*, like numbers referring to like elements. As depicted, side 2 522 of the belt strap 519 (black face) is visible to the viewer. The keeper assembly 525 has been reversed with respect to what is shown in FIG. 2*c* at (1). The keeper 507 has its side 2 508*b* (black face) shown, matching the front side of the belt strap 519 now. Even though the foldback sub-portion of the fixed end 512 portion is shown with side 1 521 (white face), after belt buckling it will be covered by the free end 511 portion of the belt strap 519. The belt clip 528 is fitted over the belt strap fixed end 512 portion. However, it may need to be adjustably slid along the belt strap 519, so that following belt buckling and final threading of the free end 511 portion for a desired length, the snap fastener 515 installed on the first leaf 513 of the belt clip 528 is aligned with and fastened to the mating snap fastener 516*a* disposed on side 1 521 (not visible) of the belt strap free end 511 portion. The decorative cap 517 is to be placed over the snap fastener's 516*a* doubled-sided counterpart 516*b* on side 2 522 to conceal the same from view.

FIG. 2*j* is a front elevation view of a reversible belt attachment system 500*c* illustrating one embodiment of attaching the waist belt 520" of FIG. 2*i* to the garment such as trousers 504 of FIG. 2*a* in closed position in accordance with the present invention. The description of FIG. 2*j* refers to elements of FIGS. 1 and 2*a*-2*i*, like numbers referring to like elements. FIG. 2*j* is virtually a duplication of FIG. 2*a* except that the former shows side 2 522 (black face) of the double-sided belt strap 519 with matching keeper 507 side 2 508*b*, and the latter shows side 1 521 (white face) of the belt strap 519 with matching keeper 507 side 1 508*a*. Otherwise, the visible parts of the belt 520" are identical to those of the belt 520. As such, repeated description of FIG. 2*j* is not provided herein.

According to the present invention, FIGS. 3*a*-3*d* are reversible waist belts attachable to the belt attachment system 500*a*, each using the plain vanilla belt strap 519 (having no adornments or special features unless otherwise noted in individual cases), a belt buckle resembling one of those conventional belt buckles shown in FIGS. 1*c*-1*f*, respectively, but without prong or rear projection, and the same belt clip 528 but with either the same or alternative pair of fastening devices for the two fastening elements forming adjustable belt fastening means as previously discussed. As explained in description of FIG. 2, each such prong-less or projection-less belt buckle has a rear outer retainer loop with the same structure as that of the belt buckle 510 used with the belt 520, to prevent the outer end portion of the belt buckle from dangling after belt buckling.

Figure 3A:
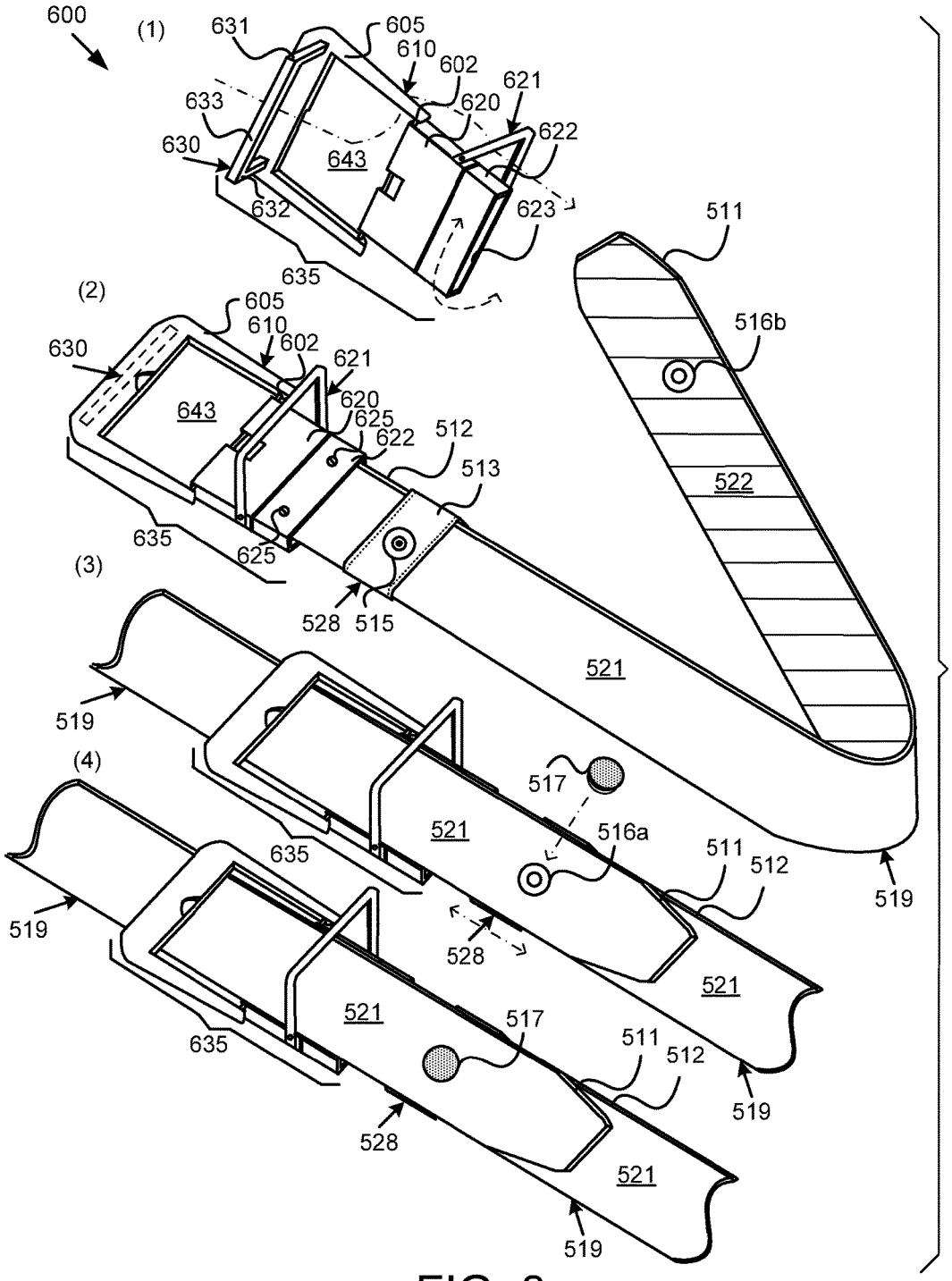
FIG. 3*a* is a front perspective view of a reversible waist belt including the double-sided belt strap and belt fastening means of FIG. 2, and a frame-style belt buckle assembly illustrating the belt's open and closed positions in accordance with one embodiment of the present invention.

FIG. 3*a* is a front perspective view of a reversible waist belt 600 including the double-sided belt strap 519 and elements of belt fastening means 528, 516*a* and 516*b* of FIG. 2, and a frame-style belt buckle assembly 635 illustrating the belt's open and closed positions in accordance with one embodiment of the present invention. The description of FIG. 3*a* refers to elements of FIGS. 1 and 2, like numbers referring to like elements. Like the conventional belt buckle assembly 235, the belt buckle assembly 635 shown in rear view at (1) and front view at (2) includes a frame-style belt buckle 630 with a belt buckle body 605 and an end bar 602, an attached belt buckle connector 620, a rotatable belt reverser 622 attached thereto, a rear outer retainer loop 630 and a front inner retainer loop 621. The two 3-piece retainer loops have like basic structure, and that structure has been described previously. The structure and function of the belt buckle assembly 635 are essentially the same as those of the belt buckle assembly 235 of FIG. 1*c*, except that the rear outer retainer loop 630 takes place of the prong 206 of the latter in terms of keeping the outer end 605 portion from dangling (not in terms of belt fastening).

The dashed-dotted line arrow at (1) indicates a belt buckle insertion path of the free end 511 portion, which represents that the free end 511 portion is to be first threaded through the rear outer retainer loop 630, extended outwardly through the open space 643 created by the belt buckle 630, and then continued through the front retainer loop 621. Illustrated at (2) is open position of the belt 600 with the belt strap 519 attached to the belt housing 623 of the belt reverser 622, the belt clip 528 engaging the belt strap fixed end 512 portion, the snap fastener 515 installed on the outer surface of the first leaf 513 of the belt clip 528, and the mating snap fastener 516*b* secured to the belt strap free end 511 portion on side 2 522 with its double-sided counterpart 516*a* (hidden from view) installed on side 1 521. The belt 600 closed position is illustrated at (2) and (3), with the belt clip 528 being slid along the belt strap 519 appropriately so that the snap fastener 515 may be aligned with and fastened to the snap fastener 516*b*. The decorative cap 517 is placed over the snap fastener 516*a*, like the belt 520 shown in FIG. 2*a*. The belt 600 in its closed position resembles that of the conventional belt 200, except for the exposure of the top edge and bottom edge of the belt clip 528 and the presence of the decorative cap 517.

Figure 3B:
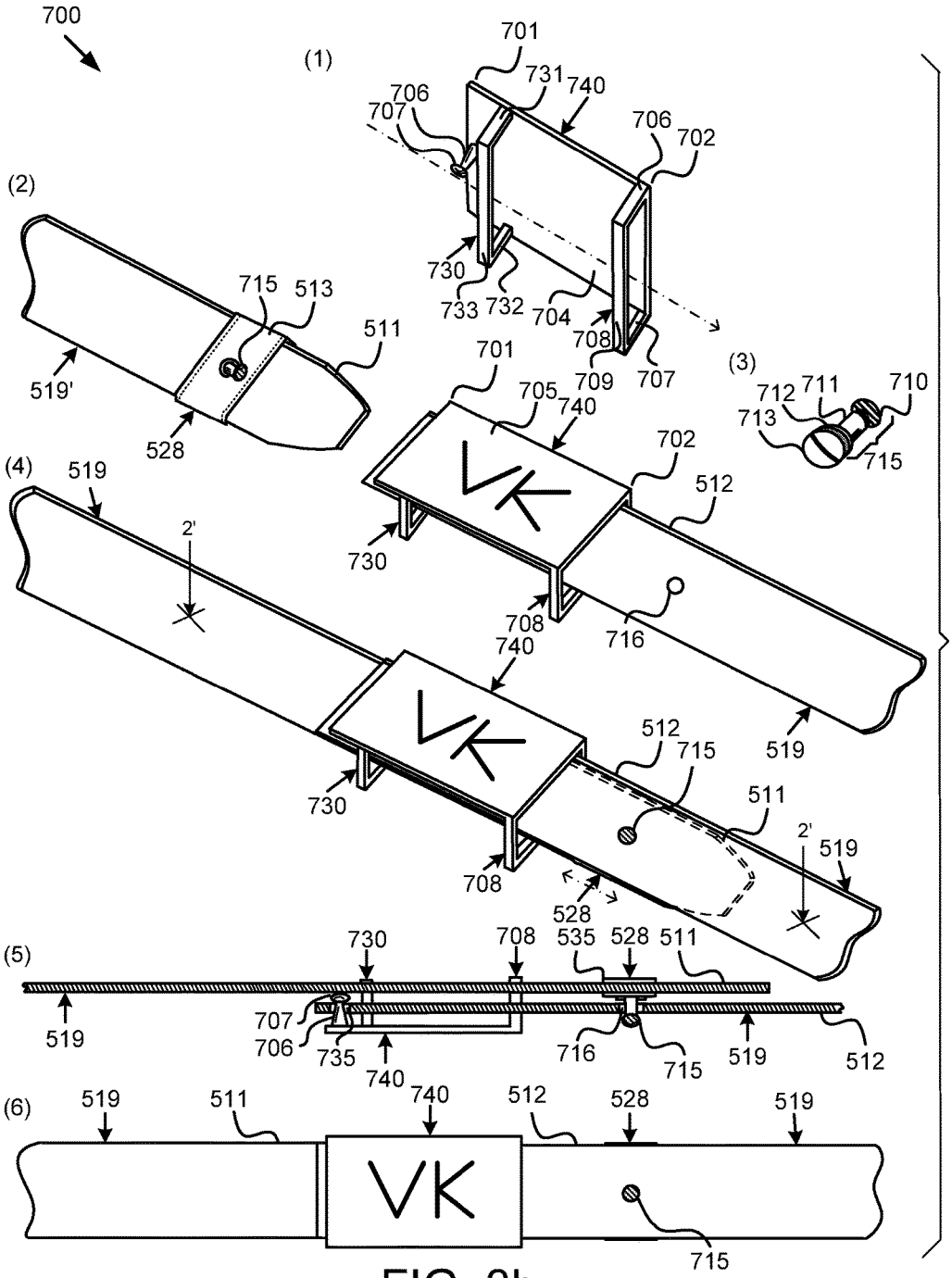
FIG. 3*b* is a front perspective view of a reversible waist belt including the belt strap and the belt clip of FIG. 2 with first alternative pair of fastening devices, and a removable plate-style belt buckle, illustrating the belt's open and closed positions in accordance with one embodiment of the present invention.

FIG. 3*b* is a front perspective view of a reversible waist belt 700 including the belt strap 519 and the belt clip 528 of FIG. 2 with first alternative pair of fastening devices, and a removable plate-style belt buckle 740, illustrating the belt's open and closed positions in accordance with one embodiment of the present invention. The description of FIG. 3*b* refers to elements of FIGS. 1, 2, and 3*a*, like numbers referring to like elements. As illustrated in front perspective view of its open position at (2), the belt 700 includes the free end 511 and the fixed end 512 portions of the belt strap 519, the belt buckle 740, the belt clip 528 engaging the belt strap free end 511 portion, a projecting stud 715 attached to the outer surface of the first leaf 513 of the belt clip 528, and a through hole 716 punched on the belt strap fixed end 512 portion adjacent the belt buckle 740 intended to allow the projecting stud 715 to be inserted through for fastening the belt 700. The belt strap 519 herein has an attachment through hole 735 adjacent the terminal portion of the fixed end 512 portion of the belt strap 519, as illustrated at (5).

The belt buckle 740 resembling the conventional belt buckle 340 includes a plate front face 705, which has two characters V and K, a plain rear face 704 and a rear inner retainer loop 708 adjacent an inner end 702 as illustrated in a rear perspective view of the belt buckle 740 at (1). Like the belt buckle 340, on the rear face 704 adjacent an outer end 701, a projection 706 with an enlarged head 707 is located at the midpoint of the outer edge and perpendicular to the rear face 704. In addition to all said parts, which the belt buckle 340 also has, the belt buckle 740 has a rear outer retainer loop 730 adjacent the outer end 701 on the rear face 704 and to the right of the projection 706, including two spaced parallel legs 731 and 732 perpendicularly mounted on the rear face 704 and a transverse cross bar 733 joining them at their other ends and situated at a more remote point from the rear face 704 than the projection 706. The rear outer retainer loop 730 may be made an integral part of the belt buckle 740. As mentioned previously, said retainer loop holds the outer end 701 portion of the belt buckle 740 from dangling after the belt strap free end 511 portion is inserted through the belt buckle 740. The dashed-dotted lined arrow at (1) indicates the path of such insertion, that is, first through the rear outer retainer loop 730 and then through the rear inner retainer loop 708.

The projecting stud 715 may be any one of those commercially available studs used on articles such as buckle-less belts, handbags, gun slips, cartridge bags, and so forth. For discussion herein, a Sam Brown screw stud is chosen. Illustrated at (3) is an enlarged perspective view of one embodiment of a Sam Brown stud 715 with a screw back 713, wherein the Sam Brown stud includes a head 710, an internally threaded shaft 711 and a base ring 712 connected to the shaft 711. The screw back 713 is screwed into the center of the base ring 712 for fastening the two halves of the Sam Brown screw stud together. After installation at the center of the first leaf 513, the Sam Brown stud 715 is visible on the outer surface of the covering for the first leaf 513 of the belt clip 528 whereas the screw back 713 stays on the inner surface of the covering of the first leaf 513, which is hidden from view. One skilled in the art, who is familiar with stud attachment methods and tools, can attach this fastener to the belt clip 528 for engaging the through hole 716 to fasten the belt 700 before the coverings of the belt clip 528 are finally stitched. This kind of stud may be made from nickel-plated sheet metal, brass or gold and comes in various lengths, for example, 5-6 mm. Note that it is not advisable to have such studs attached to both leaves of the belt clip 528 because an unused stud may make the wearer uncomfortable.

Illustrated at (4) is a front perspective view of the belt 700 in closed position, wherein the free end 511 portion lies behind the fixed end 512 portion, with the projecting stud 715 engaging the through hole 716, most likely only the head of the projecting stud 715 being visible, after the projecting stud 715 is aligned with the through hole 716 by adjustably sliding the belt clip 528 along the free end 511 portion of the belt strap 519. The illustration at (5) gives a sectional view taken substantially along the line 2'-2' of the illustration at (4) with the belt buckle 740 turned upside down. As shown, the projection 706 with the enlarged head 707 is inserted into the attachment through hole 735 in the fixed end 512 portion of the belt strap 519. Both said belt strap end portions are passed through the rear outer retainer loop 730 and extended through the rear inner retainer loop 708 and beyond the inner end 702 of the belt buckle 740. The belt clip 528 engaging the free end 511 portion of the belt strap 519 has its projecting stud 715 (of a Sam Brown stud type) inserted through the through hole 716 on the fixed end portion of the belt strap 519. A part of the U-bend 535 of the belt clip 528 is visible. Illustrated at (6) is a front elevational view of the belt 600 fully assembled in closed position, showing the top edge and the bottom edge of the belt clip 528 and the presence of the head of the projecting stud 715. This appearance resembles that of the conventional belt 300 of FIG. 1*d* as illustrated at (5) therein.

Figure 3C:
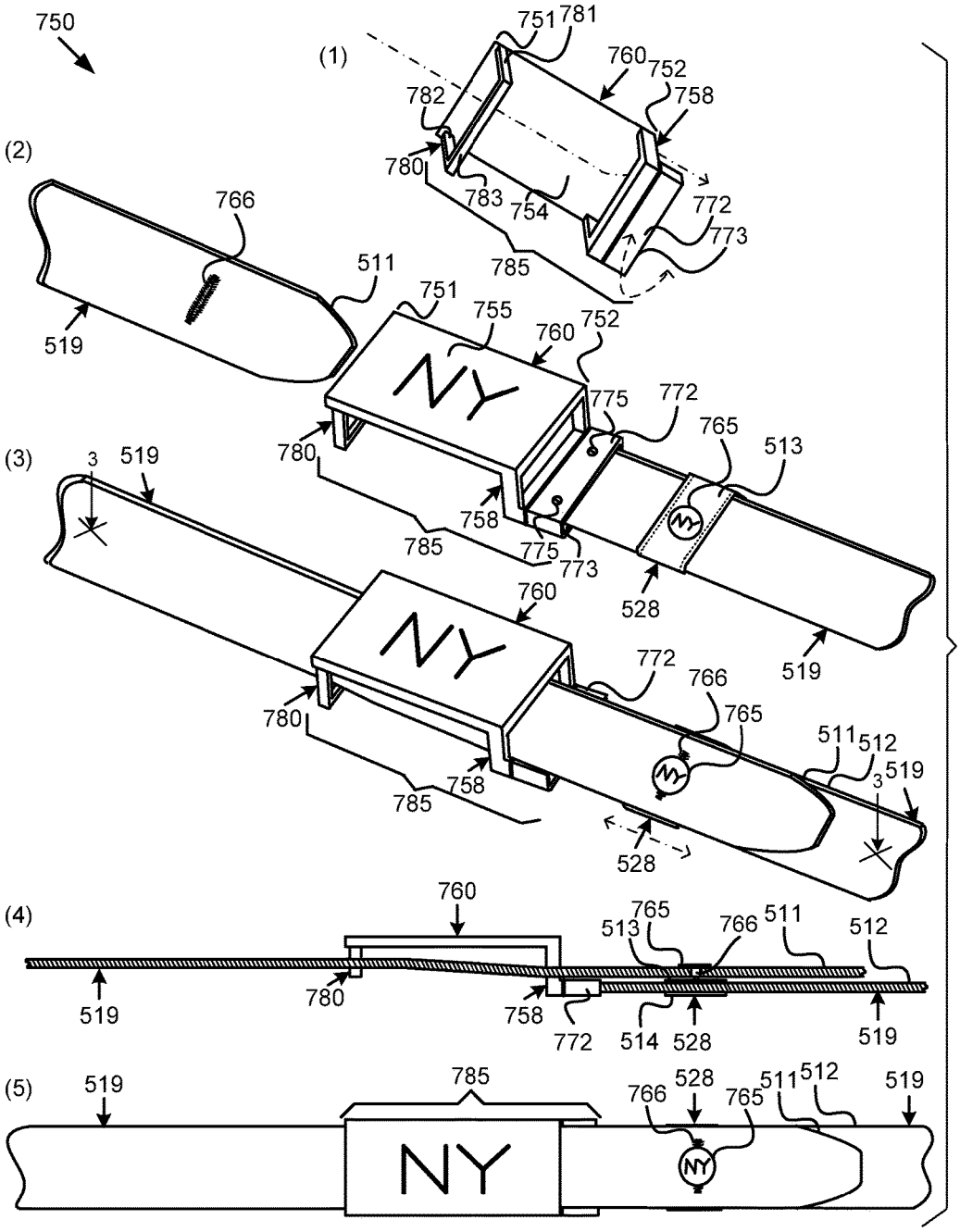
FIG. 3*c* is a front perspective view of a reversible waist belt including the belt strap and the belt clip of FIG. 2 with second alternative pair of fastening devices, and a plate-style belt buckle assembly, illustrating the belt's open and closed positions in accordance with one embodiment of the present invention.

FIG. 3*c* is a front perspective view of a reversible waist belt 750 including the belt strap 519 and the belt clip 528 of FIG. 2 with second alternative pair of fastening devices, and a plate-style belt buckle assembly 785, illustrating the belt's 750 open and closed positions in accordance with one embodiment of the present invention. The description of FIG. 3*c* refers to elements of FIGS. 1, 2, and 3*a*-3*b*, like numbers referring to like elements. As illustrated in front perspective view of its open position at (2), the belt 750 includes the free end 511 and the fixed end 512 portions of the belt strap 519, the belt buckle assembly 785, the belt clip 528, which engages the fixed end 512 portion and has a sewn-on button 765 of a logo type stitched to the outer surface of its first leaf 513 covering at the center, and a centrally-positioned through buttonhole 766 (with stitches shown) made through the belt strap 519 adjacent the tip end of the free end 511 portion intended for the button 765 to be fastened to on belt fastening.

Like the conventional belt buckle assembly 385 of FIG. 1*e*, the belt buckle assembly 785 shown in rear view at (1) and front view at (2) includes a plate-style belt buckle 760 with a belt buckle plate front face 755 and rear face 754, a rear inner retainer loop 758, a rotatable belt reverser 772 attached to the cross bar thereof. Unlike the belt buckle assembly 385, the belt buckle assembly 785 has a familiar rear outer retainer loop 780 adjacent the edge of an outer end 751 without any projection as illustrated at (1) and (2). The rear outer retainer loop 780 is used to prevent the outer end 751 portion of the belt buckle 760 from dangling after belt buckling.

Illustrated at (3) is a front perspective view of the belt 750 in closed position. To reach that position, the free end 511 portion passes through the rear outer retainer loop 780 first and then through the inner retainer loop 758 to maintain a parallel relation with the fixed end 512 portion of the belt strap 519 but overlaps the latter, with the button 765 fastened to the buttonhole 766, possibly requiring the belt clip 528 to adjustably slide along the belt strap 519 to allow the button 765 to align with the buttonhole 766 first. Illustrated at (4) is a sectional view of the belt 750 in closed position taken substantially along the line 3-3 of the illustration at (3) and directed toward the distal end of the belt buckle 760, showing edges of the first leaf 513 and the second leaf 514 of the belt clip 528, with the button 765 from the belt clip 528 put through the buttonhole 766 on the free end 511 portion. A front elevational view of the belt 750 fully assembled is illustrated at (5), which resembles that of the conventional belt 350.

Figure 3D:
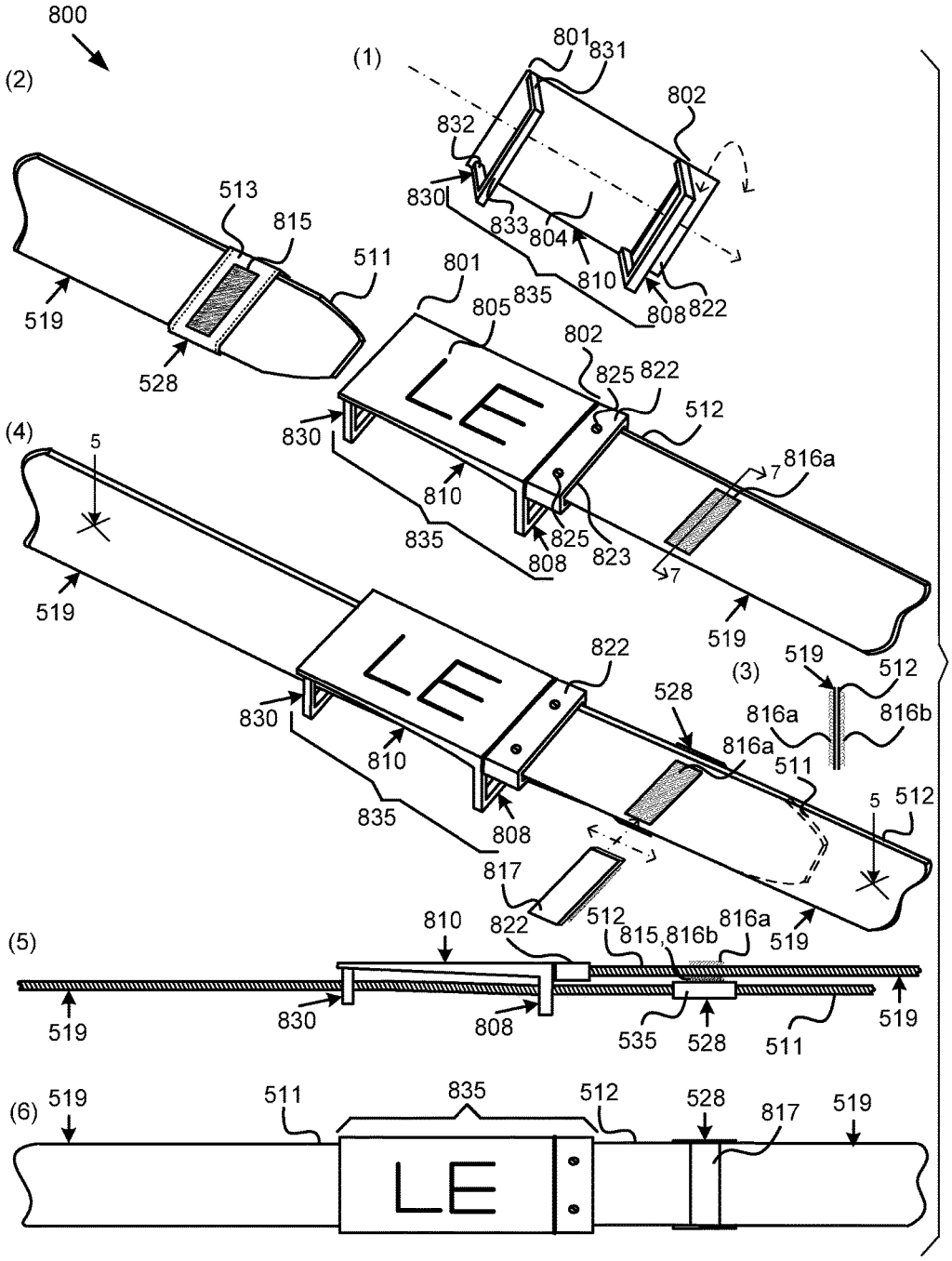
FIG. 3*d* is a front perspective view of a reversible waist belt including the belt strap and the belt clip of FIG. 2 with third alternative pair of fastening devices, and another plate-style belt buckle assembly, illustrating the belt's open and closed positions in accordance with one embodiment of the present invention.

FIG. 3*d* is a front perspective view of a reversible waist belt 800 including the belt strap 519 and the belt clip 528 of FIG. 2 with third alternative pair of fastening devices, and another plate-style belt buckle assembly 835, illustrating the belt's 800 open and closed positions in accordance with one embodiment of the present invention. The description of FIG. 3*d* refers to elements of FIGS. 1, 2, and 3*a*-3*c*, like numbers referring to like elements. As illustrated in front perspective view of its open position at (2), the belt 800 includes the free end 511 and the fixed end 512 portions of the belt strap 519, the belt buckle assembly 835, the belt clip 528, which engages the free end 511 portion and has a sewn-on loop fastener strip 815 including loops of the hook-and-loop fastener type (also commonly referred to as Velcro®) centrally positioned on the outer surface of its first leaf 513, and a centrally-positioned hook fastener strip 816*a* including hooks of the hook-and-loop fastener type sewn on the belt strap fixed end 512 portion adjacent the belt reverser 822, with its double-sided counterpart 816*b* on the underside (not visible) used to fasten to the loop fastener strip 815 following a possibly required alignment of the belt clip 528 on belt fastening.

Like the conventional belt buckle assembly 435 of FIG. 1*f*, the belt buckle assembly 835 shown in rear view at (1) and front view at (2) includes a plate-style belt buckle 810 with a belt buckle plate front face 805 and rear face 804, a rear inner retainer loop 808, a rotatable belt reverser 822 attached to the base thereof, which is an end part of the belt buckle 810 located at an inner end 802. Unlike the belt buckle assembly 435, the belt buckle assembly 835 without a projection has a familiar rear outer retainer loop 830 adjacent the edge of an outer end 801 of the belt buckle 810, as illustrated at (1) and (2), used to prevent the outer end 801 portion of the belt buckle 810 from dangling after belt buckling.

Illustrated at (3) is a side cross sectional view of the double-sided hook fasteners 816*a* (and 816*b*) disposed on both sides of the fixed end 512 portion of the belt strap 519 taken along the line 7-7 of the illustration at (2). As shown, hook fastener strip 816*a* lies on front side of the belt strap 519 and hook fastener strip 816*b*, on the opposite side. Illustrated at (4) is a front perspective view of the belt 800 in closed position. To reach that position, the free end 511 portion passes first through the rear outer retainer loop 830 and then through the inner retainer loop 808, such as indicated with dashed-dotted line arrow at (1), to reach a parallel relation with the fixed end 512 portion of the belt strap 519 but underlaps the latter, with the loop fastener strip 815 fastened to the hook fastener strip 816*b* (not visible herein but shown at (5), possibly requiring the belt clip 528 to adjustably slide along the belt strap 519 to allow the loop fastener strip 815 to align with the hook fastener strip 816*b* first. Illustrated at (5) is a sectional view of the belt 800 in closed position taken substantially along the line 5-5 of the illustration at (4) and directed toward the proximal end of the belt buckle 810, showing the exterior of the U-bend 535 of the belt clip 528, with the loop fastener strip 815 fastened to the hook fastener strip 816*b*, with the hook fastener strip 816*a*, the double-sided counterpart of the hook fastener strip 816*b*, exposed, which is shown at (4). Also shown at (4), is a decorative strip 817 with Velcro® loops on its underside standing by to be placed over the hook fastener strip 816*a* with a matching size, so that said fastener strip is concealed from front view. A front elevation view the belt 800 fully assembled is illustrated at (6), which resembles that of the conventional belt 400. Note that in certain embodiments, a hook-and-eye type of fasteners may be used instead of hook-and-loop fasteners.

Figure 4A:
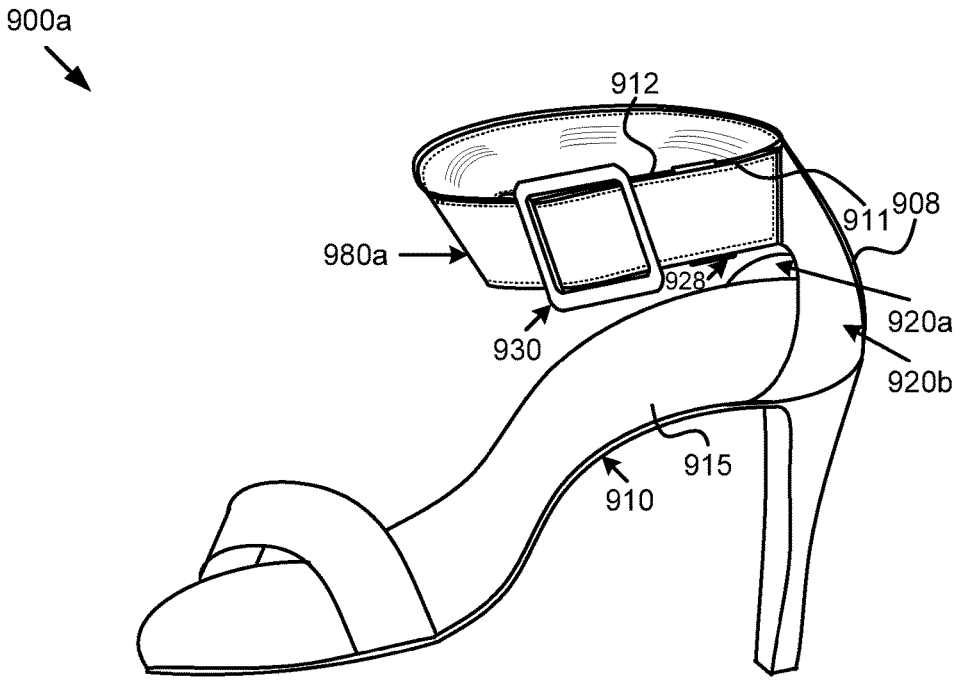
FIG. 4*a* is a perspective view of a system for fitting a non-garment article such as shoe with an exemplary integral belt fastenable around a wearer's ankle illustrated in closed position in accordance with one embodiment of the present invention.
Figure 4B:
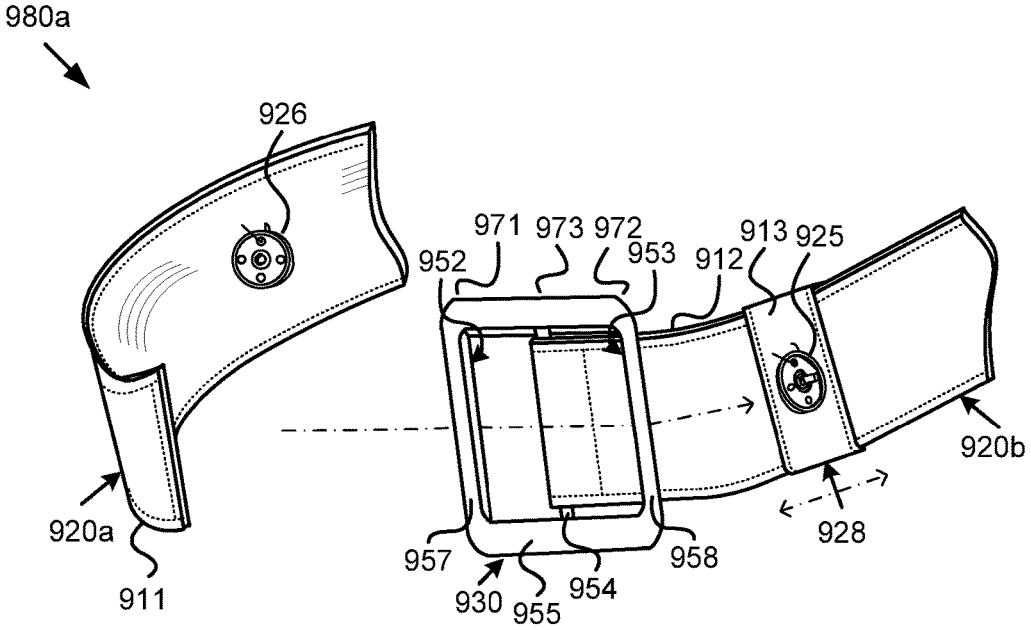
FIG. 4*b* is an exploded fragmentary perspective view of the integral belt of FIG. 4*a* illustrating one embodiment of its open position in accordance with the present invention.
Figure 4C:
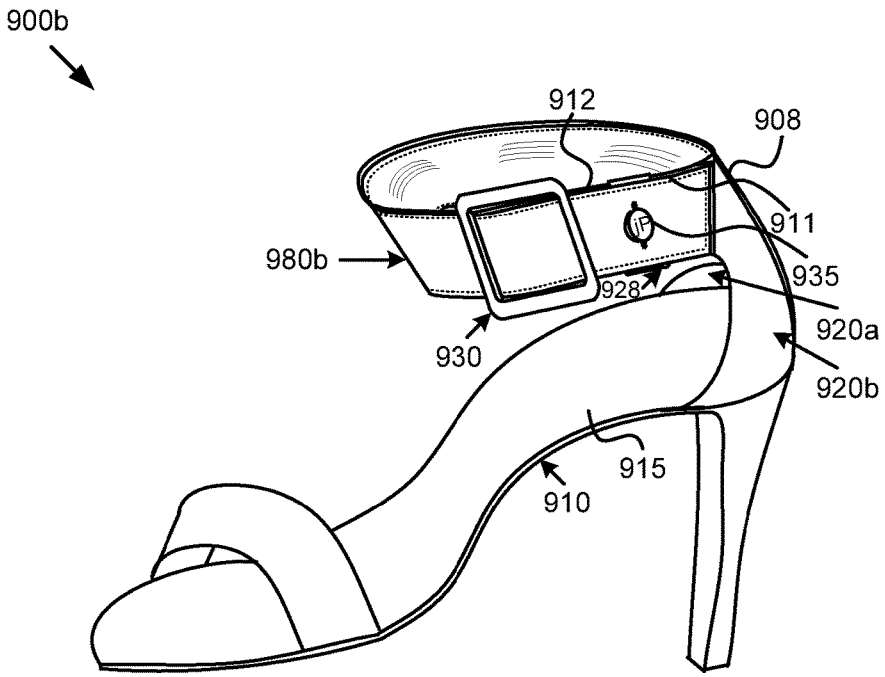
FIG. 4*c* is a drawing similar to FIG. 4*a* except for showing a first alternate fastening device pair in use in accordance with one embodiment of the present invention.
Figure 4D:
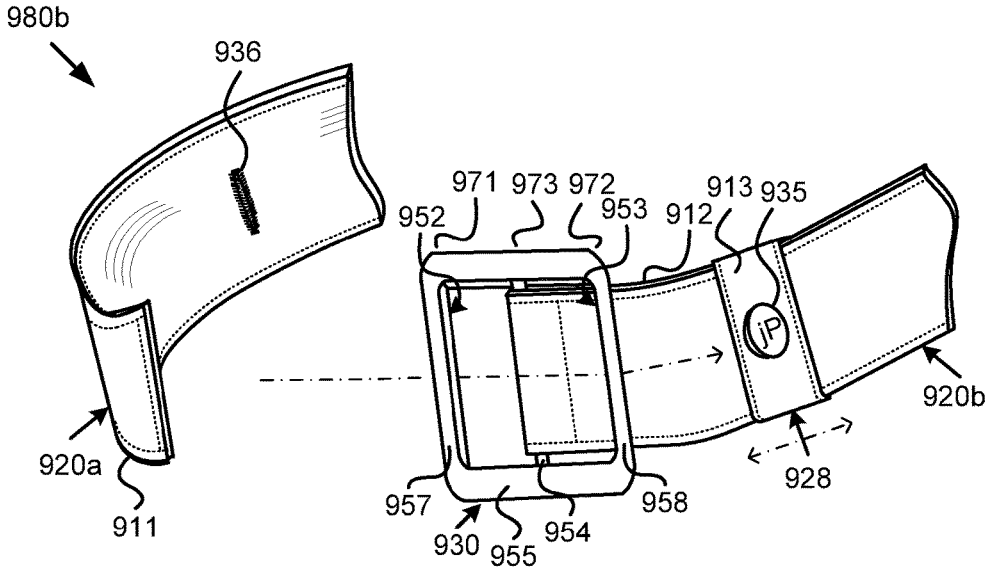
FIG. 4*d* is a drawing similar to FIG. 4*b* except for showing the first alternate fastening device pair in use in accordance with the present invention.
Figure 4E:
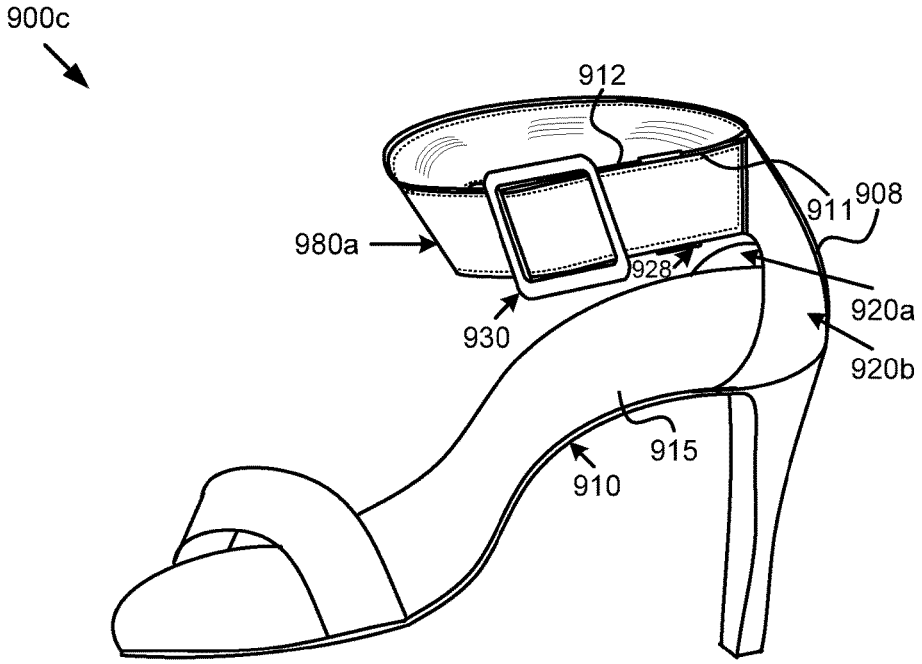
FIG. 4*e* is a drawing similar to FIG. 4*a* except for showing a second alternate fastening device pair in use in accordance with the present invention.
Figure 4F:
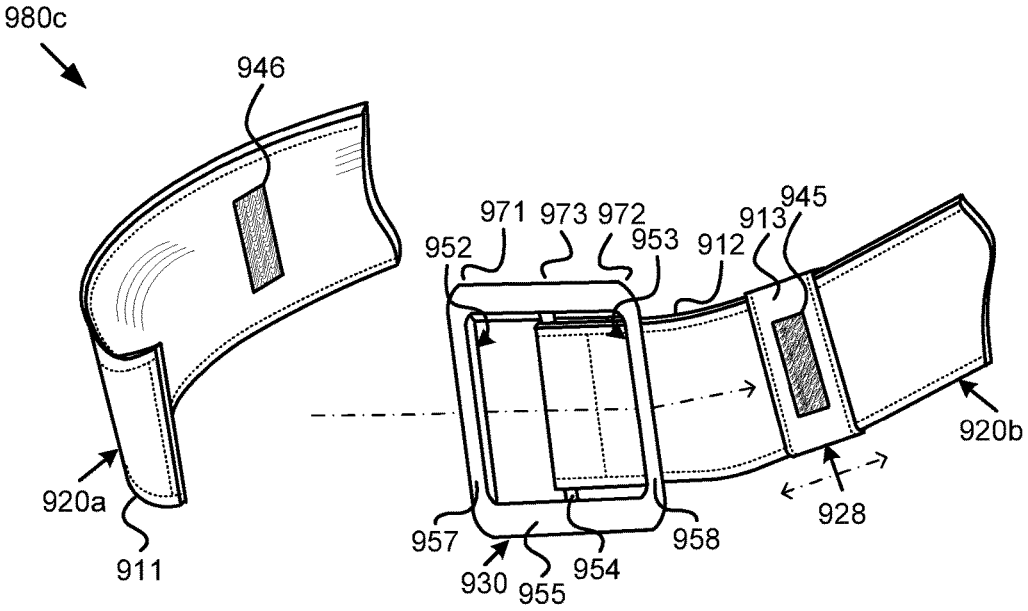
FIG. 4*f* is a drawing similar to FIG. 4*b* except for showing the second alternate fastening device pair in use in accordance with the present invention.

FIG. 4*a* is a perspective view of a system 900*a* for fitting a non-garment article such as shoe with an exemplary integral belt 980*a* fastenable around a wearer's ankle illustrated in closed position in accordance with one embodiment of the present invention. The description of FIG. 4*a* refers to FIGS. 1-3, like numbers referring to like elements. As depicted, the system 900*a* includes a shoe 910 and its integral belt 980*a*. The shoe 910 has a shoe body 915 and other components such as sole, front strap and heel. The integral belt 980*a* of the shoe 910 includes a first belt strap 920*a* and a second belt strap 920*b*. The two belt straps are connected such as by sewing together at a strap joint 908. Each of the two belt straps is affixed to the shoe body 915 at one end. At the other end, the first belt strap 920*a* has a free end 911 portion, and the second belt strap 920*b* has a fixed end 912 portion. The free end 911 portion of the belt strap 920*a* has no adjusting holes, unlike its counterpart of the conventional belt 150 of FIG. 1*b* at (2). In addition, the integral belt 980*a* has a prong-less belt buckle 930 and a belt clip 928, which together with two belt fastening elements (not visible) forms belt fastening means for the belt 980*a* in place of the prong and hole combination used for belt fastening as with the belt 150. The fixed end's 912 terminal portion of the second belt strap 920*b* is folded back around a center bar 954 (best seen in FIG. 4*b*) of the belt buckle 930 and secured to itself with stitches. As usual, the free end 911 portion begins threading through the belt buckle 930 from underside thereof at an outer end toward an inner end and beyond for a desired distance and fastened to the fixed end 912 portion with said belt fastening means due to be detailed in the description of FIG. 4*b*.

FIG. 4*b* is an exploded fragmentary perspective view of the integral belt 980*a* of FIG. 4*a* illustrating one embodiment of its open position in accordance with the present invention. The description of FIG. 4*b* refers to elements of FIGS. 1-3 and 4*a*, like numbers referring to like elements. As shown, the integral belt 980*a* includes the free end 911 portion of the belt strap 920*a*, which has a sewn-on snap fastener (female) 926 adjacent the terminal end of the free end 911 portion on the backside of the belt strap 920*a*, the open frame-style belt buckle 930 with the center bar 954 at an inner end 973, the fixed end 912 portion of the belt strap 920*b* secured to the center bar 954 of the belt buckle 930, and the belt clip 928 having all-around coverings with a sewn-on snap fastener (male) 925 installed at a center of its first leaf 913. The belt clip 928 engages the fixed end 912 portion of the belt strap 920*b*, with the first leaf 913 facing the front.

Like the conventional belt buckle 180 of the belt 150, the belt buckle 930 has a first outer end 971 and a second outer end 972 in addition to the inner end 973. In addition, the belt buckle 930 has an elongated belt buckle body 955, which has an opening being divided by the center bar 954 into two slots 952 and 953, bounded by sides bars 957 and 958, respectively. In a similar manner to that used by the belt 150, the free end 911 portion is inserted through the belt buckle 930 first through the slot 952 from the underside to the outside, extended over the center bar 954 and then back to the underside through the slot 953 and beyond. Unlike the belt buckle 180, the belt buckle 930 has no prong. Belt fastening for the belt 980*a* makes use of a stationary first fastening element, which uses the snap fastener 926, and a co-acting second fastening element, which uses the snap fastener 925 carried by the belt clip 928, which is adjustably slidable longitudinally along the belt strap 920*b* to align with the snap fastener 926, like belt fastening means used by the waist belt 520 of FIG. 2*a*.

Except for different sizing required by shoe belt fastening, the structure and functions of the belt clip 928 are essentially the same as those of the belt clip 528 illustrated in FIG. 2, especially FIGS. 2*e* and 2*f* thereof. Therefore, no repeated description of the belt clip 928 is provided herein. In a preferred embodiment, the inside length of the belt clip 928 with coverings matches the width of the fixed end 912 portion of the belt strap 920*b*, so that during sliding of the belt clip 928 engaging the latter, no strap tilting to one side occurs. Following belt buckling so that the free end 911 portion reaches a desired distance and maintains a parallel relation with the fixed 912 portion and overlaps the latter, the belt 980*a* is fastened by fastening the snap fastener 925 to the snap fastener 926 after the former is aligned with the latter by manually sliding the belt clip 928 as appropriate by the wearer as discussed in description of FIG. 2. The front perspective view of the belt 980*a* in thus attained closed position is shown in FIG. 4*a*, with top edge and bottom edge of the belt clip 928 barely conspicuous.

Although not shown but alluded to, a belt buckle like the type of the belt buckle 930 herein can also be used on a single-sided as well as reversible waist belt in accordance with the present invention. As explained in the description of a conventional waist belt 150, the free end of a reversed reversible belt strap can be threaded through the belt buckle from the second outer end 972 toward its inner end 973. This type of belt buckle 930 without a prong is basically a tri-glide buckle, currently widely used in industry for clothing, handbags, travel bags and so on. As mentioned previously, because of its inherent structure, this type of belt buckle requires no outer retainer loop on the rear side like that of the belt buckle 510 shown in FIG. 2*d* to prevent dangling of the outer end portion of the belt buckle 510 following belt buckling.

FIGS. 4*c* and 4*d* and FIGS. 4*e* and 4*f* are substantially similar to FIGS. 4*a* and 4*b*, respectively, except that a fastening device pair used by the first fastening element and the second fastening element in each case is different. As depicted, the fastening device pair of FIGS. 4*c* and 4*d* includes a button hole 936 and a logo-type of button 935, similar to those of FIG. 3*c*. The fastening device pair of FIGS. 4*e* and 4*f* includes hook fastener strip 946 and loop fastener strip 945, both of the Vecro® hook-and-loop fasteners, similar to those of FIG. 3*d*.

Figure 5A:
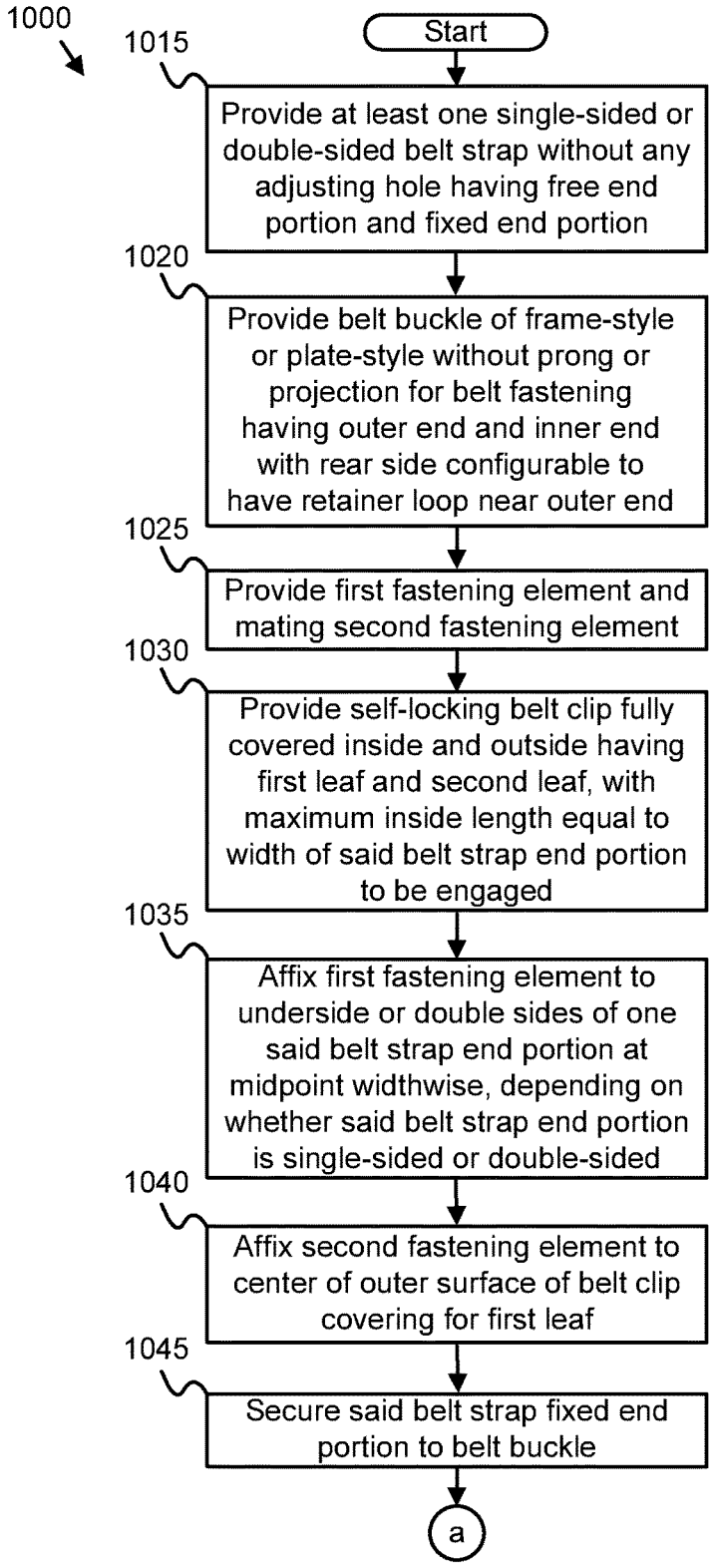
FIGS. 5*a* and 5*b* are a flow chart diagram illustrating one embodiment of a method for assembling and disassembling a belt such as the waist belt of FIG. 2*a* in accordance with the present invention.
Figure 5B:
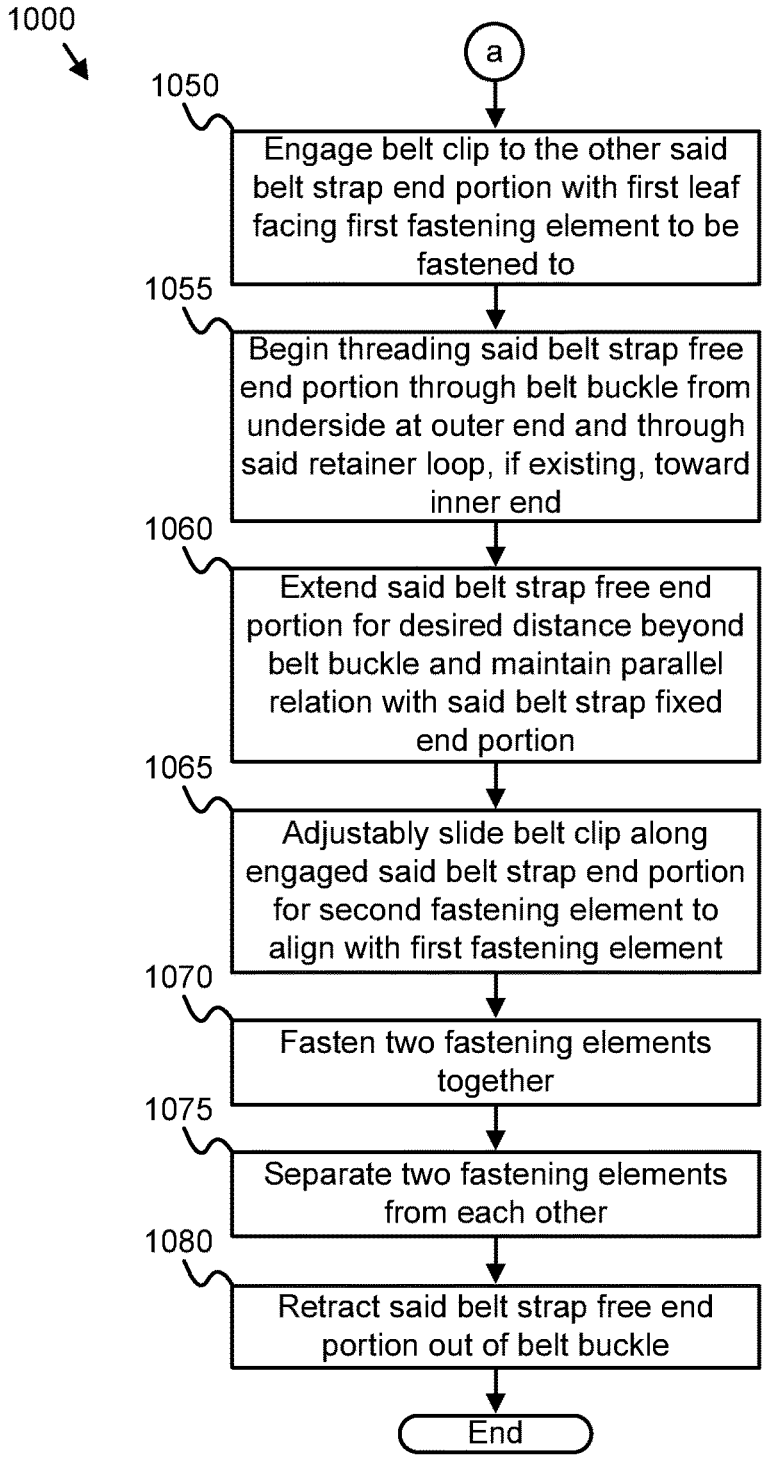

FIGS. 5*a* and 5*b* are a flow chart diagram illustrating one embodiment of a method 1000 for assembling and disassembling a belt such as the waist belt 520 of FIG. 2*a* in accordance with the present invention. The description of the method 1000 refers to elements of FIGS. 1-4, like numbers referring to like elements. The method begins an assembling operation by providing 1015 at least one single-sided or double-sided belt strap without any adjusting hole punched therethrough, said at least one belt strap having a free end portion and a fixed end portion. The belt 520 has one double-sided belt strap 519, which has a free end 511 portion and a fixed end 512 portion. The method 1000 further provides 1020 a belt buckle of a frame-style or plate-style type without a prong or projection for belt fastening and having an out end and an inner end with the rear side configurable to have a retainer loop near the outer end. The belt buckle 510 used on the belt 520 is a frame-style type, including an outer end 506*a* and an inner end 506*b* shown in FIG. 2*a*. The rear side of a belt buckle body 504 of the belt buckle 510 is configured to have a retainer loop 530 near the outer end 506*a* as shown in FIG. 2*d* at (1), which prevents the outer end 506*a* portion of the belt buckle 510 from dangling after belt buckling. The method 1000 continues to provide 1025 a first fastening element and a mating second fastening element such as the snap fastener 516*b* and snap fastener 515, respectively, for the belt 520 as shown in FIG. 2*c*. The method 1000 then provides 1030 a belt clip 528 of the self-locking type fully covered with coverings inside and outside having a first leaf 513 and a second leaf 514 as shown in FIG. 2*e*, with its maximum inside length L set to equal the width W of the belt strap 519.

The method 1000 proceeds to affix 1035 the first fastening element, which is the snap fastener 516*b* in this case, to the underside 522 of one belt strap end portion, which is the free end 511 portion of the belt strap 519, at a midpoint widthwise, and its double-sided counterpart snap fastener 516*a* to the front side 521 at the same position since the belt strap 519 is double-sided, as illustrated in FIG. 2*c*. The method 1000 further affixes 1040 the second fastening element, the snap fastener 515, to the center of the outer surface of the covering for the first leaf 513 of the belt clip 528 shown in FIG. 2*c*.

The method 1000 proceeds further to secure 1045 the fixed end 512 portion of the belt strap 519 to the belt buckle 510. The method 1000 engages 1050 the belt clip 528 to the other belt strap end portion, which is the fixed end 512 portion, facing the snap fastener 516*b* that is to be fastened to, as illustrated in FIG. 2*c*. at (2).

With all elements of belt fastening means put in place, the method 1000 begins threading 1055 the free end 511 portion of the belt strap 519 through the belt buckle 510 from underside thereof and through the rear outer retainer loop 530 at the outer end 506*a* toward the inner end 506*b*, as shown in FIG. 2*d* at (2). The method 1000 further extends 1060 the travel of the free end 511 portion beyond the belt buckle 510 for a user desired distance and maintain a parallel relation with the fixed end 512 portion. The method 1000 then adjustably slides 1065 the belt clip 528 along the engaged belt strap fixed end 512 portion for the snap fastener 515 to align with the snap fastener 516*b* as illustrated in FIG. 2*d* at (3). To complete the belt assembling operation, the method fastens 1070 the two snap fasteners 516*b* and 515 together. To begin a belt disassembling operation, the method 1000 first separates 1075 the two snap fasteners 516*b* and 515 and then retracts 1080 the free end 511 portion of the belt strap 519 out of the belt buckle 510, a reversal of the insertion path indicated in FIG. 2*d* at (1).

Figure 6:
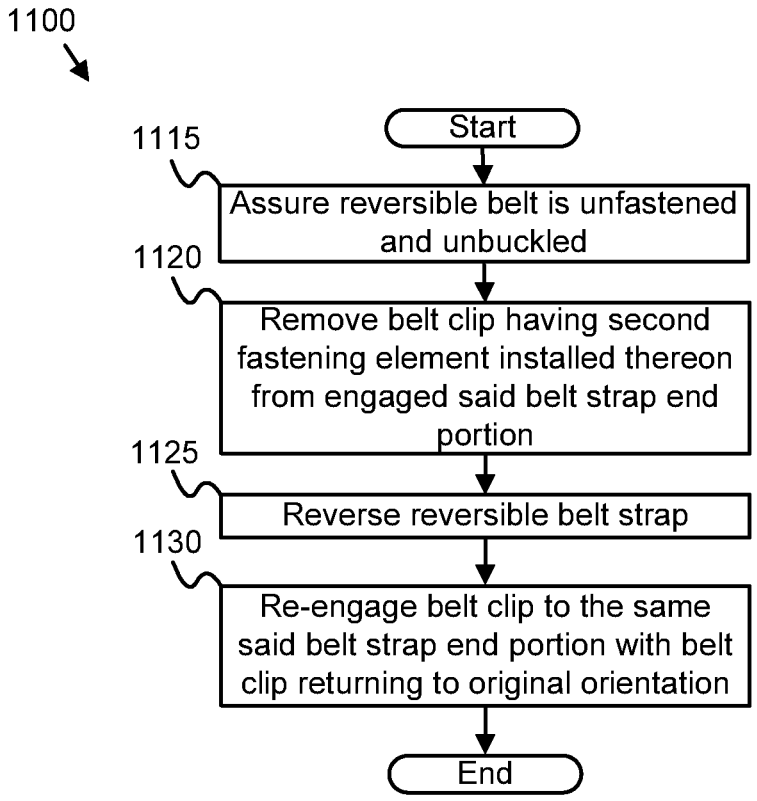
FIG. 6 is a flow chart diagram illustrating one embodiment of a method for reversing a reversible belt such as the belt of FIG. 2*a* in accordance with the present invention.

FIG. 6 is a flow chart diagram illustrating one embodiment of a method 1100 for reversing a reversible belt such as the belt 520 of FIG. 2*a* in accordance with the present invention. The description of the method 1100 refers to elements of FIGS. 1-5, like numbers referring to like elements. The method 1100 begins with assuring 1115 that the belt 520 is unfastened and unbuckled. The method 1100 proceeds to remove 1120 the belt clip 528 engaging the fixed end 512 portion from the belt strap 519 as illustrated in FIG. 2*g* in one embodiment. As mentioned previously, the belt clip 528 may alternately be removed from the belt strap 519 by sliding it all the way toward the other end of the belt strap 519, which is the free end 511 portion until it gets off the free end 511 portion completely. Once the belt clip 528 is removed from the belt strap 519, the method 1100 reverses 1125 the belt strap 519 such as by a manual method. With a reversible belt such as the belt 600, rotating the belt reverser 622 connected to the belt buckle 630 by 180° will cause the belt strap 519 to be reversed. The method 1100 finally re-engages the belt clip 528 to the fixed end 512 portion of the belt strap 519, with the belt clip 528 maintaining the original orientation assumed prior to the reversal of the belt strap 519.

According to the present invention, a belt normally used on a garment such as trousers or a non-garment article such as footwear can be provided with at least one belt strap having no adjusting holes coupled with a popular conventional buckle without its prong or projection that is used to fasten the belt strap free end portion and fixed end portion together for a convention belt. Required prevention of the outer end portion of the belt buckle from dangling after belt buckling in the absence of a prong or projection, however, is made possible by providing a retainer loop on the rear side of the belt buckle near the outer end to receive the free end portion firstly. Although not for the same purpose, this kind of retainer loops have been widely utilized on a variety of popular conventional belt buckles. To fasten the new hole-less and prong-less belt with remaining parts of a popular belt buckle retained for its familiar aesthetic appearance and well-known non-functional significance, replacement belt fastening means includes a stationary fastening element and a co-actable mating fastening element carried by an adjustably slidable self-locking belt clip, engageable on the free end portion or the fixed portions of the belt strap. For an equally adjustable reversible belt, the stationary fastening element is installed double-sided although the slidable mating fastening element may optionally remain single-sided as it can be manually reoriented after a belt strap reversal. A variety of fastening device pairs and ornaments are provided for selectability so as not to compromise aesthetic appearance of the reversible belt. Consequently, unlimited belt size adjustability for single-sided and reversible belts is provided as desired by the user, and the problem of wear and tear of the belt strap resulting from use of prong and adjusting holes may be eliminated. The embodiments may be practiced in other specific forms. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An adjustable belt comprising:

a belt strap made of a single-sided material or a two-sided reversible material, wherein the entire said belt strap is devoid of any adjusting holes such that fastening and adjustment of the belt strap between a free end portion thereof and an opposite, fixed end portion thereof occurs with a belt buckle, a locking belt clip and two fastening elements;

the free end portion of the belt strap configured to be mobile through the belt buckle which is attached to a terminal portion of the fixed end portion of the belt strap;

the belt strap designed to be looped around a wearer's waist with the free end portion overlapping the fixed end portion or vice versa, upon such looping, whereby the belt strap is configured to be arranged in a closed position;

the belt buckle characterized by being devoid of any prong and having an open space extending therethrough configured to allow any desired amount of the free end portion of the belt strap to be threaded therethrough, comprising:

a. a frame having a front side opposite a rear side, and an inner end at one lateral side opposite an outer end at a second lateral side, the open space of the belt buckle extending between the inner end at the one lateral side and the outer end at the second lateral side, the front side of the frame facing frontward with the adjustable belt being in the closed position, the rear side of the frame being opposite of the front side facing rearward, the inner end of the frame being secured to the terminal portion of the fixed end portion of the belt strap, and the outer end of the frame opposite the inner end of the frame configured to receive the free end portion of the belt strap from behind the rear side of the frame toward the inner end of the frame; and b. a retainer loop mounted on the rear side of the frame adjacent the outer end thereof, the retainer loop configured to receive therethrough the free end portion of the belt strap, the retainer loop comprising two spaced apart, parallel legs perpendicularly secured to the rear side of the frame of the belt buckle and a transverse cross bar joining the two spaced apart, parallel legs therebetween to form a loop structure defining a slot, the slot configured for receiving the free end portion of the belt strap therethrough;

a first fastening element of the two fastening elements being affixed to the free end portion of the belt strap on a rear side of said single-sided material or on both sides of said two-sided reversible material, the first fastening element of the free end portion configured to pass through the open space of the belt buckle to reach the closed position of the belt strap;

the locking belt clip insertable over the fixed end portion of the belt strap configured to engage one side of the free end portion of the belt strap that is overlapped with the fixed end portion of the belt strap in a locked position with friction, and configured to be manually slidable lengthwise by hand of the wearer along the belt strap as much as desired by the wearer for belt fastening, and to remain locked in place upon termination of said sliding, the locking belt clip comprising a first leaf facing front and a second leaf facing rear, said first and second leafs joined to each other at lower ends thereof and contacting each other but being separable at respective upper ends to enable insertion over the fixed end portion of the belt strap; and a second fastening element of the two fastening elements affixed to the locking belt clip on an outer surface of the first leaf, the second fastening element positioned and configured to mate with the first fastening element and to be detachably fastened thereonto upon alignment therewith by the locking belt clip through said manual sliding, whereby the adjustable belt is capable of being fastened following any desired overlapping length adjustment of the free end portion of the belt strap with the fixed end portion of the belt strap.

2. The adjustable belt of claim 1, wherein the locking belt clip is in the form of a U-shape unitary resilient spring clip made from material selected from the group consisting of metal, plastic and other suitable material.

3. The adjustable belt of claim 2, wherein the first leaf and the second leaf of the locking belt clip are parallel, approximately of equal length, and joined together to form a semi-circular U-shape bend at the lower ends.

4. The adjustable belt of claim 3, wherein the length of the first leaf and the length of the second leaf of the locking belt clip are substantially equal to a width of the belt strap.

5. The adjustable belt of claim 1, wherein the first fastening element and the second fastening element are mating snap fasteners, non-magnetic or magnetic.

6. An adjustable belt system comprising:

a garment configured to be worn by a wearer; and an adjustable belt designed to be worn around a waist section of the garment by the wearer, comprising:

a belt strap made of a single-sided material or a two-sided reversible material, wherein the entire said belt strap is devoid of any adjusting holes such that fastening and adjustment of the belt strap between a free end portion thereof and an opposite, fixed end portion thereof occurs with a belt buckle, a locking belt clip and two fastening elements;

the free end portion of the belt strap configured to be mobile through the belt buckle which is attached to a terminal portion of the fixed end portion of the belt strap;

the belt strap designed to be looped around a waist of the wearer with the free end portion overlapping the fixed end portion or vice versa, upon such looping, whereby the belt strap is configured to be arranged in a closed position;

the belt buckle characterized by being devoid of any prong and having an open space extending therethrough configured to allow any desired amount of the free end portion of the belt strap to be threaded therethrough, comprising:

a. a frame having a front side opposite a rear side, and an inner end at one lateral side opposite an outer end at a second lateral side, the open space of the belt buckle extending between the inner end at the one lateral side and the outer end at the second lateral side, the front side of the frame facing frontward with the adjustable belt being in the closed position, the rear side of the frame being opposite of the front side facing rearward, the inner end of the frame being secured to the terminal portion of the fixed end portion of the belt strap, and the outer end of the frame opposite the inner end of the frame configured to receive the free end portion of the belt strap from behind the rear side of the frame toward the inner end of the frame; and b. a retainer loop mounted on the rear side of the frame adjacent the outer end thereof, the retainer loop configured to receive therethrough the free end portion of the belt strap, the retainer loop comprising two spaced apart, parallel legs perpendicularly secured to the rear side of the frame of the belt buckle and a transverse cross bar joining the two spaced apart, parallel legs therebetween to form a loop structure defining a slot, the slot configured for receiving the free end portion of the belt strap therethrough;

a first fastening element of the two fastening elements being affixed to the free end portion of the belt strap on a rear side of said single-sided material or on both sides of said two-sided reversible material, the first fastening element of the free end portion configured to pass through the open space of the belt buckle to reach the closed position of the belt strap;

the locking belt clip insertable over the fixed end portion of the belt strap configured to engage one side of the free end portion of the belt strap that is overlapped with the fixed end portion of the belt strap in a locked position with friction, and configured to be manually slidable lengthwise by hand of the wearer along the belt strap as much as desired by the wearer for belt fastening, and to remain locked in place upon termination of said sliding, the locking belt clip comprising a first leaf facing front and a second leaf facing rear, said first and second leafs joined to each other at lower ends thereof and contacting each other but being separable at respective upper ends to enable insertion over the fixed end portion of the belt strap;

a second fastening element of the two fastening elements affixed to the locking belt clip on an outer surface of the first leaf, the second fastening element positioned and configured to mate with the first fastening element and to be detachably fastened thereonto upon alignment therewith by the locking belt clip through said manual sliding, whereby the adjustable belt is capable of being fastened following any desired overlapping length adjustment of the free end portion of the belt strap with the fixed end portion of the belt strap;

wherein the waist section of the garment is configured to have a belt attachment support structure of a waist band with surrounding sewn-on belt loops to hold the adjustable belt in place.

7. The adjustable belt system of claim 6, wherein the locking belt clip is in the form of a U-shape unitary resilient spring clip made from material selected from the group consisting of metal, plastic and other suitable material.

8. The adjustable belt system of claim 7, wherein the first leaf and the second leaf of the locking belt clip are parallel, approximately of equal length, and joined together to form a semi-circular U-shape bend at the lower ends.

9. The adjustable belt system of claim 8, wherein the length of the first leaf and the length of the second leaf of the locking belt clip are substantially equal to a width of the belt strap.

10. The adjustable belt system of claim 6, wherein the first fastening element and the second fastening element are mating snap fasteners, non-magnetic or magnetic.

11. A method for assembling and disassembling an adjustable belt comprising:

providing a belt strap made of a single-sided material or a two-sided reversible material, wherein the entire said belt strap is devoid of any adjusting holes such that fastening and adjustment of the belt strap between a free end portion thereof and an opposite, fixed end portion thereof occurs with a provided belt buckle, a locking belt clip and two fastening elements;

securing the fixed end portion of the belt strap to the belt buckle;

the free end portion of the belt strap configured to be mobile through the belt buckle which is attached to a terminal portion of the fixed end portion of the belt strap;

the belt strap designed to be looped around a wearer's waist with the free end portion overlapping the fixed end portion or vice versa, upon such looping, whereby the belt strap is configured to be arranged in a closed position;

the belt buckle characterized by being devoid of any prong and having an open space extending therethrough configured to allow any desired amount of the free end portion of the belt strap to be threaded therethrough, comprising:

a. a frame having a front side opposite a rear side, and an inner end at one lateral side opposite an outer end at a second lateral side, the open space of the belt buckle extending between the inner end at the one lateral side and the outer end at the second lateral side, the front side of the frame facing frontward with the adjustable belt being in the closed position, the rear side of the frame being opposite of the front side facing rearward, the inner end of the frame being secured to the terminal portion of the fixed end portion of the belt strap, and the outer end of the frame opposite the inner end of the frame configured to receive the free end portion of the belt strap from behind the rear side of the frame toward the inner end of the frame; and b. a retainer loop mounted on the rear side of the frame adjacent the outer end thereof, the retainer loop configured to receive therethrough the free end portion of the belt strap, the retainer loop comprising two spaced apart, parallel legs perpendicularly secured to the rear side of the frame of the belt buckle and a transverse cross bar joining the two spaced apart, parallel legs therebetween to form a loop structure defining a slot, the slot configured to receive the free end portion of the belt strap therethrough;

affixing a first fastening element of the two fastening elements to the free end portion at a midpoint widthwise of the belt strap on a rear side of said single-sided material or on both sides of said two-sided reversible material, the first fastening element of the free end portion configured to pass through the open space of the belt buckle to reach the closed position of the belt strap;

inserting the locking belt clip over the fixed end portion of the belt strap configured to engage one side of the free end portion of the belt strap that is overlapped with the fixed end portion of the belt strap in a locked position with friction, and configured to be manually slidable lengthwise by hand of the wearer along the belt strap as much as desired by the wearer for belt fastening, and to remain locked in place upon termination of said sliding, the locking belt clip comprising a first leaf facing front and a second leaf facing rear, said first and second leafs joined to each other at lower ends thereof and contacting each other but being separable at respective upper ends to enable insertion over the fixed end portion of the belt strap; and affixing a second fastening element of the two fastening elements to the locking belt clip at a center of an outer surface of the first leaf, the second fastening element positioned and configured to mate with the first fastening element and to be detachably fastened thereonto upon alignment therewith by the locking belt clip through said manual sliding, whereby the adjustable belt is capable of being fastened following any desired overlapping length adjustment of the free end portion of the belt strap with the fixed end portion of the belt strap;

threading the free end portion of the belt strap through the belt buckle toward the inner end of the frame from the rear side at the outer end of the frame via the retainer loop and then through the open space of the frame;

extending the free end portion of the belt strap for a desired distance beyond the belt buckle and maintaining a parallel relation with the fixed end portion of the belt strap;

adjustably sliding the locking belt clip along the fixed end portion of the belt strap by manual force by a hand of the wearer for the second fastening element to align with the first fastening element;

fastening the first and second fastening elements together;

separating the first and second fastening elements from each other; and retracting the free end portion of the belt strap out of the belt buckle.

12. The method of claim 11, wherein a third fastening element is further installed on the second leaf of the belt clip at a similar position to the second fastening element installed on the first leaf, whereby when the belt strap is reversed for another side of the two-sided reversible material to be selected to be visible, the belt clip is reversed and becomes inverted but operable.

* * * * *